US006969324B1

(12) United States Patent
Staehs

(10) Patent No.: US 6,969,324 B1
(45) Date of Patent: Nov. 29, 2005

(54) PORTABLE AUTOMATIC GOLF BALL TEEING APPARATUS

(75) Inventor: James Paul Staehs, San Jose, CA (US)

(73) Assignee: James Staehs, San Jose, CA (US)

( * ) Notice: Subject to any disclaimer, the term of this patent is extended or adjusted under 35 U.S.C. 154(b) by 64 days.

(21) Appl. No.: 10/871,973

(22) Filed: Jun. 17, 2004

(51) Int. Cl.[7] ..... A63B 69/36
(52) U.S. Cl. ..... 473/136
(58) Field of Search ..... 473/132–134, 473/136, 137

(56) References Cited

U.S. PATENT DOCUMENTS

| | | | | |
|---|---|---|---|---|
| 3,448,985 | A | | 6/1969 | Scott |
| 3,519,275 | A | | 7/1970 | Meierjohan |
| 3,901,515 | A | | 8/1975 | Mozel |
| 4,017,087 | A | | 4/1977 | Bruno |
| 4,355,811 | A | | 10/1982 | Williams |
| 4,602,789 | A | | 7/1986 | Chung |
| 4,741,537 | A | | 5/1988 | Adam |
| 5,016,886 | A | | 5/1991 | Gould |
| 5,052,688 | A | | 10/1991 | Shiau |
| 5,131,661 | A | | 7/1992 | Jorgensen |
| 5,133,557 | A | | 7/1992 | Sugimoto |
| 5,351,964 | A | | 10/1994 | Kruger |
| 5,356,148 | A | | 10/1994 | Elder, Jr. |
| 5,458,339 | A | * | 10/1995 | Wildes ..... 473/137 |
| 5,647,805 | A | * | 7/1997 | Tarbox, Jr. ..... 473/137 |
| 5,895,325 | A | * | 4/1999 | Tomey ..... 473/134 |
| 6,159,105 | A | * | 12/2000 | Henry ..... 473/132 |
| 6,375,580 | B1 | * | 4/2002 | Schmidt et al. ..... 473/137 |

* cited by examiner

*Primary Examiner*—Steven Wong
(74) *Attorney, Agent, or Firm*—Michael W. Caldwell

(57) ABSTRACT

A storage means holds a quantity of golf balls for automatic placement upon a tee. An gating mechanism releases a single ball to roll by gravity power to a ball holder. Upon activation by the user an extendable arm causes the ball holder to be positioned over the tee, then the extendable arm rotates downwardly, leaving the ball upon the tee. A sensor signals a controller to reverse a motor, retracting the extendable arm fully. Upon full retraction a next golf ball is released to the ball holder. The user activates a new cycle by placing a golf club head in the vicinity of the invention. The invention may be battery powered and is small enough to be used anywhere.

10 Claims, 22 Drawing Sheets

PORTABLE AUTOMATIC GOLF BALL TEEING APPARATUS

FIELD OF THE INVENTION

The invention relates to a device for practicing a golf swing. More specifically to a portable device for intermittently placing a golf ball upon a tee.

BACKGROUND OF THE INVENTION

The present invention relates to devices employed for improving the skill of golfers or for the enjoyment of hitting golf balls. In particular it is an automatic golf ball teeing device, such as may be used by driving ranges, golf courses, or individuals. Other golf ball teeing devices employ a lifting mechanism that is below the level of the user requiring the apparatus to be constructed under ground or for the user to stand upon an elevated platform. Both solutions add construction costs to the cost of the apparatus itself. They also prevent the possibility of portability. With these devices, when a new ball is to be placed upon the tee, the tee is moved downwardly beneath the driving surface to receive a golf ball from the ball supply, whether the supply is above or below the driving surface. Other devices have been devised which are above the driving surface but require the user to manually actuate the apparatus, thus disturbing the user's stance.

An object of the invention is the elimination of need for any installation. Another objective is to provide an apparatus with portability such that one may easily transport the apparatus in the trunk of an automobile, in a golf cart, or by simply carrying it. Another objective of the present invention is to provide an apparatus of the character stated which may be manufactured at a cost which allows sales to consumers and commercial establishments alike.

Other objectives and advantages will become apparent from the remaining portion of the specification.

SUMMARY OF THE INVENTION

The present invention is a portable apparatus for sequentially placing golf balls upon a tee. It may be powered by line voltage or a battery, allowing use anywhere. It is completely self contained, thus no installation is required. It is also small enough and light enough that a user may take it with him or her to any desired location. The user places the device upon a flat surface and pulls down a hinged tee support plate. If the device is being used at a golf ball driving range one lifts the range's protective tee mat and places the hole in the mat over the tee of the invention. The user places a quantity of golf balls into a ball storage means and turns on a power switch. The invention waits for the user to place the head of a golf club near a photo detector to activate the sequence wherein one golf ball is placed upon the tee. The user may either hit the ball from the tee or may first knock it off the tee onto the mat or turf. When the user is ready for another ball he places the head of his club in front of the sensor at the front of the invention, and the process begins anew. The user need not change his stance to effect a new ball placement cycle.

The present invention places a golf ball upon an extendable arm including a forked end comprised of two fingers at the front end of the arm (where "front" is defined as the end closest to the user), the fingers spaced closely enough to hold a ball securely but wide enough apart to straddle the tee. The moveable piece of the extension arm is driven by a belt which is driven by a small motor. The moveable piece of the arm moves slideably along its track while a side finger rides upon a side rail which acts to keep the arm in an approximately horizontal attitude until the ball is directly over the tee. At that point the arm is no longer held up by the side rail and travels downwardly by the force of gravity, rotating about a center axle. This places the ball upon the tee as the two fingers proceed below the level of the top of the tee. Finally, the side finger trips a limit switch which is a command to a microcontroller to cause the motor to reverse its rotational direction, which action retracts the moveable piece of the arm.

As the moveable piece of the extendable arm approaches the fully retracted position the side finger moves a lever which allows a new ball to exit the ball storage means and to roll along a track, coming to rest upon and between the two fingers of the extendable arm. The device is now ready for another cycle, which will begin when the user again places a club head in the vicinity of the sensor.

DETAILED DESCRIPTION OF THE INVENTION

The present invention is comprised of four main subsystems: a horizontal arm assembly which rotates in a vertical plane with means for movement; an extendable arm for transporting a golf ball to a tee; a system for holding and intermittently releasing individual golf balls for further transport; and an electronic circuit that provides power and control to the overall system.

Many elements to be described are connected with other elements using machine screws with matching nuts, usually with a washer. Those skilled in the art will understand that an alternative embodiment would be a machine screw into a cooperatively placed tapped hole, a weld (including chemical weld) or a spot weld in lieu of a screw, or a more complete molded assembly. All described elements that include an axle formed by a machine screw and nut with a bushing could alternatively comprise a ball bearing with an inner and outer race and a shaft or an axle threaded only on an end, for example. The description provided is intended to describe the functional relationships between the elements, and should not be construed to be a strict description of the only construction method of practicing the invention.

Figure 1:
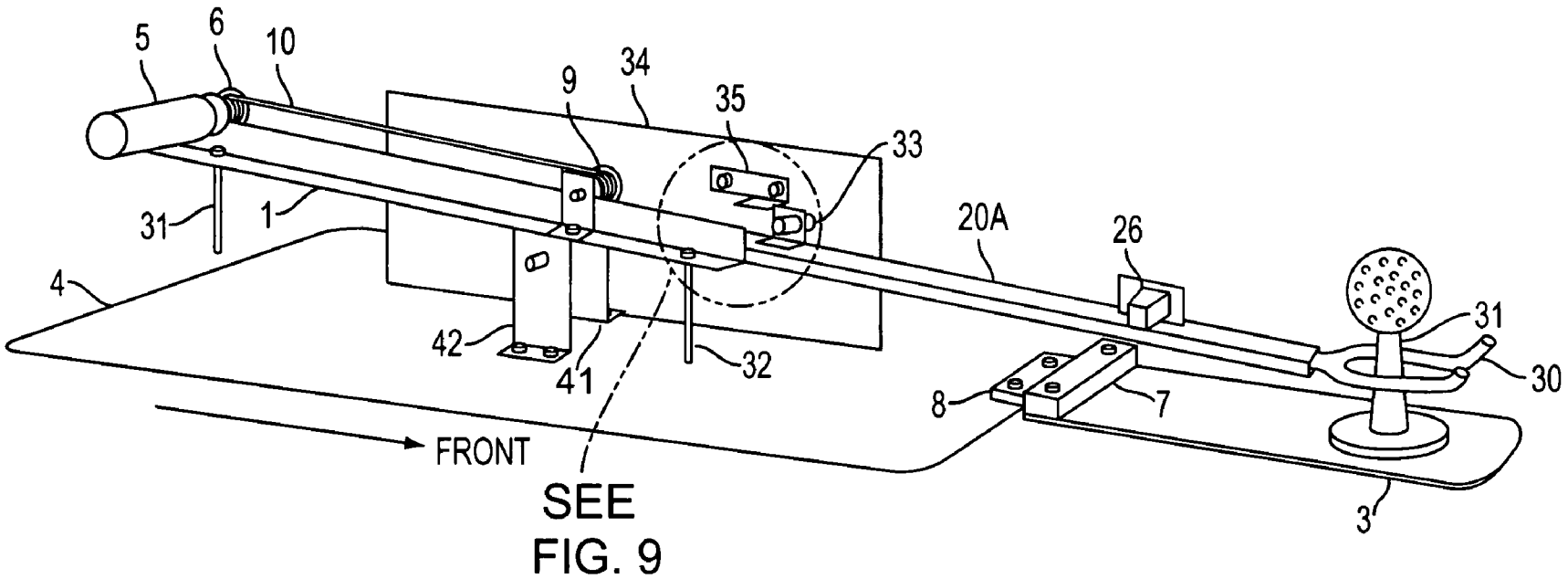
FIG. 1 is an overall view of the major components of the present invention with the extendable arm fully extended.
Figure 2:
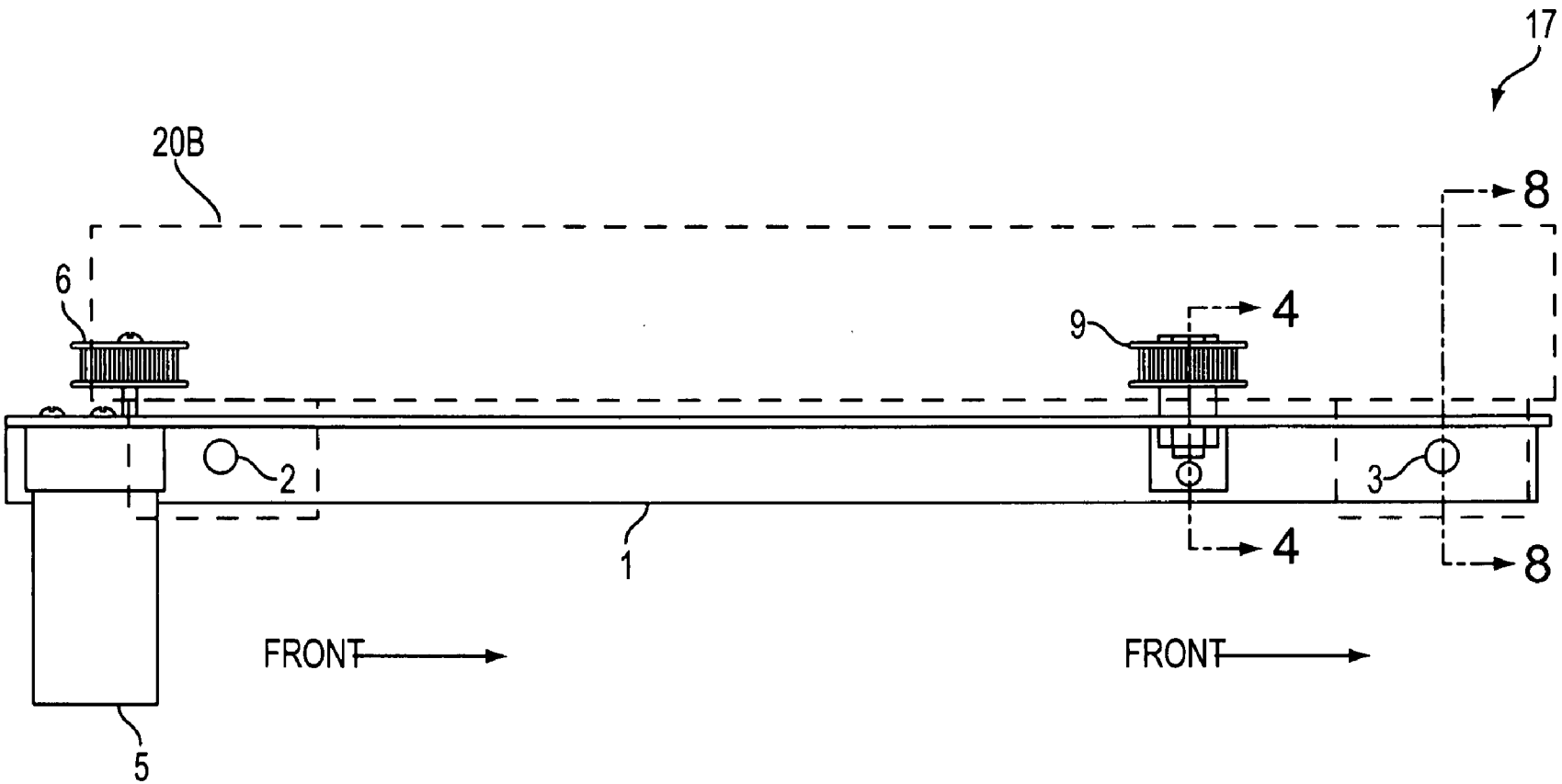
FIG. 2 is an isolated view looking down upon the horizontal arm and its attachments.
Figure 3:
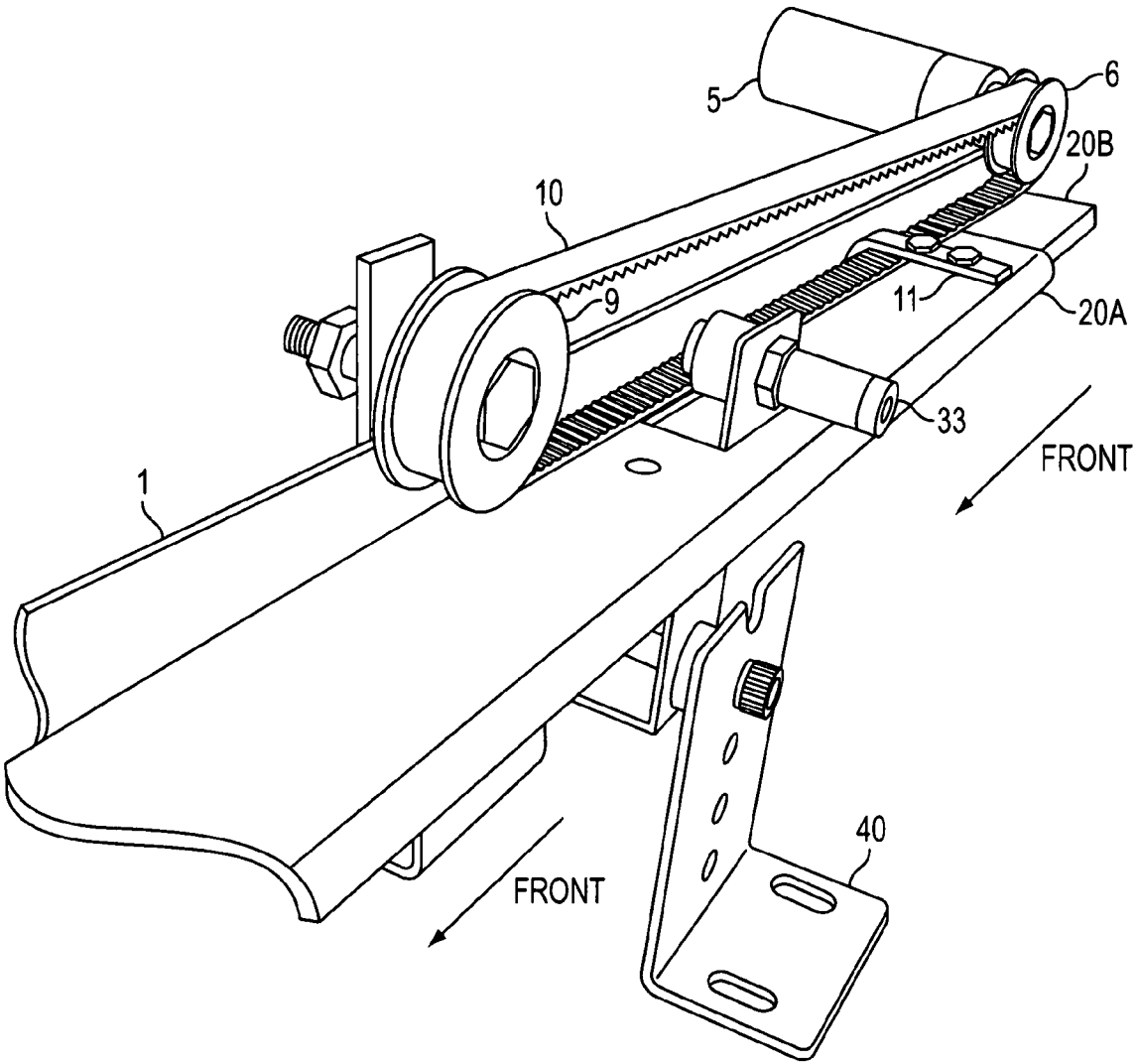
FIG. 3 is an isolated view of the assembly for moving the extendable arm piece.
Figure 4:
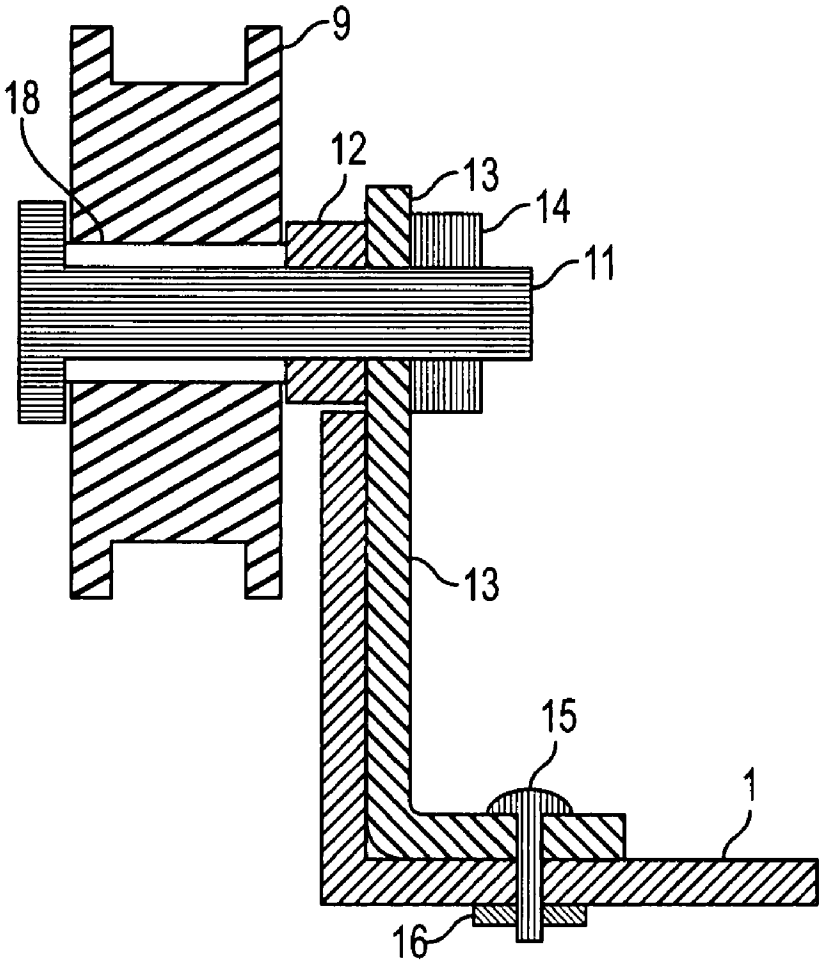
FIG. 4 is a cross section (from FIG. 2) of the front wheel assembly as it is connected with the horizontal arm.
Figure 5:
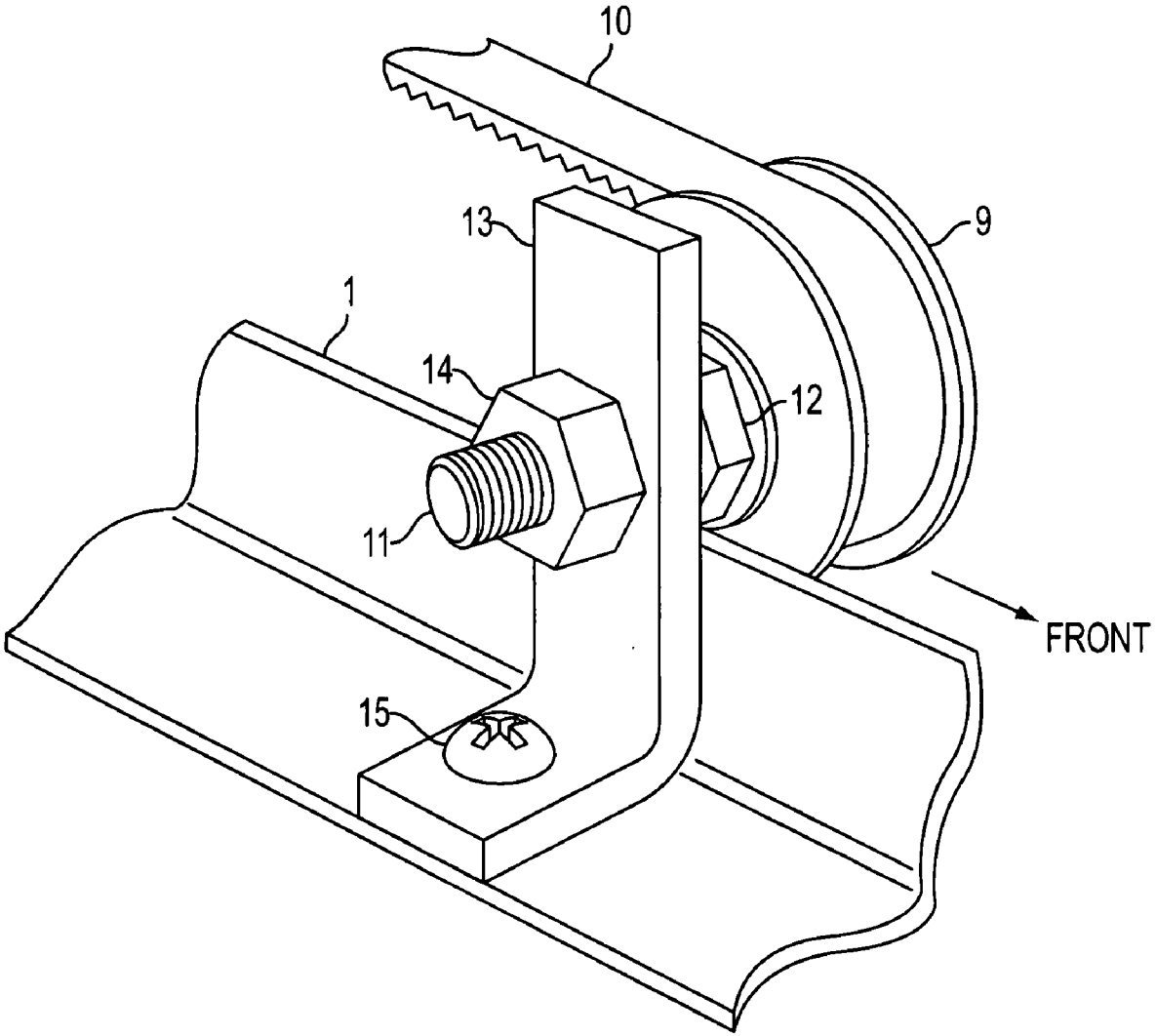
FIG. 5 is a detail of the attachment of the front wheel assembly with the horizontal arm

FIG. 1 shows the overall assembly of the invention in its fully extended position. Referring to FIG. 2, which shows the horizontal arm assembly 17 in an isolated view, in one embodiment the horizontal arm 1 is made from an aluminum "L" extrusion. A motor 5 is connected with the rear vertical portion of the horizontal arm 1. On the drive shaft of the motor 5 is a drive wheel 6. Note that motor 5 in one embodiment is a gear motor, thus the output shaft to drive wheel 6 is off center. FIG. 3 provides a perspective view of the relationship between the motor 5, horizontal arm 1, drive wheel 6, a front wheel 9, a belt 10, and an extendable arm assembly 20. A clip 11 connects belt 10 to an extendable arm 20A. In FIG. 4 we see front wheel 9 connected with horizontal arm 1 in a cross section per FIG. 2. Front wheel 9 includes an axle 18. Front wheel 9 is held in place by a bolt 11 which is inserted through axle 18 and bushing 12 and bracket 13, and is held by a nut 14. Bracket 13 is secured to horizontal arm 1 with a machine screw 15 and a nut 16. Note the orientation of horizontal arm 1. FIG. 5 provides a more perspective isolated view of front wheel 9.

Figure 6A:
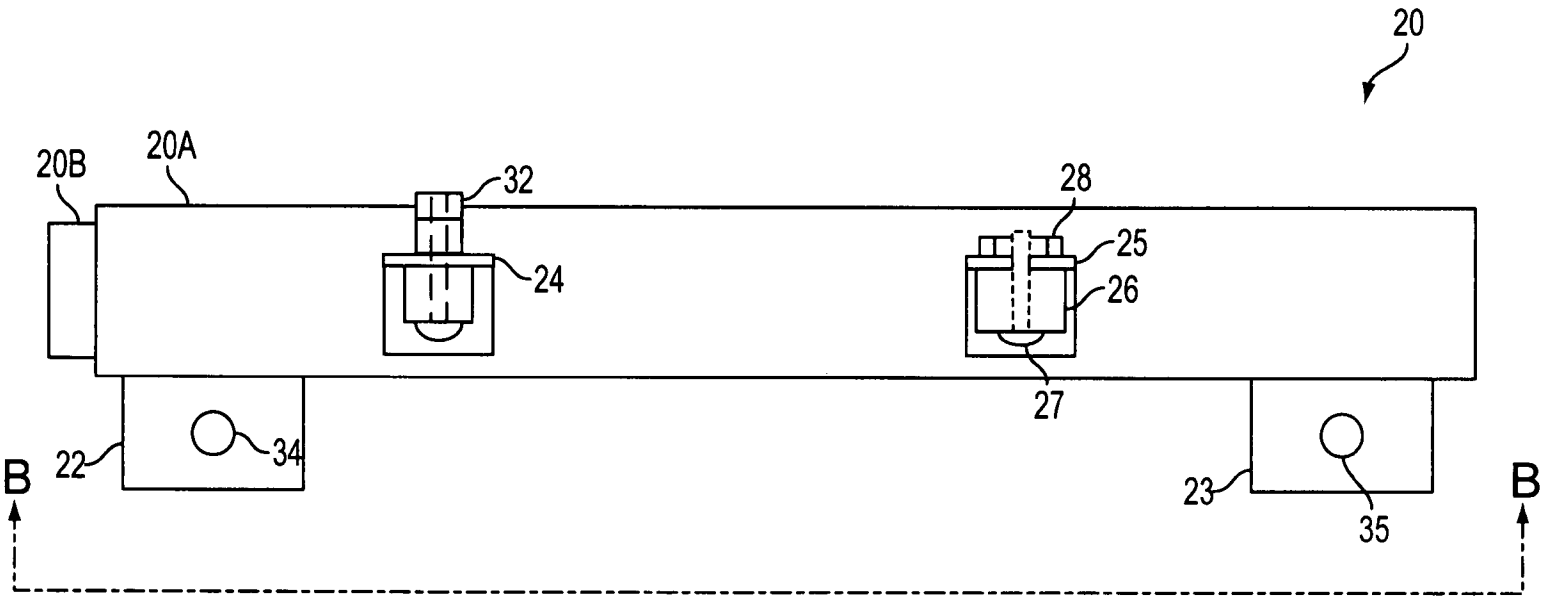
FIG. 6A is an isolated overhead view of the extendable arm and its attachments.

FIG. 6 is an isolated view of an extendable arm assembly 20. In one embodiment extendable arm assembly 20 is a slider for a computer desk drawer, commonly available at hardware stores. The assembly comprises an extendable arm 20A outside of a stationary channel 20B, the two typically retaining ball bearings, though any sliding design is acceptable. The unit as-purchased includes two tabs 24 and 25 at right angles to the extendable arm 20A, which tabs have been formed by the manufacturer by cutting a square hole on three sides and bending the tabs upwards and further includes a horizontal rear plate 22 and a horizontal front plate 23, both fixedly connected with stationary channel 20B by spot welds. Note in FIG. 6A that the stationary channel 20B may be seen through the holes in extendable arm 20A that formed tabs 24 and 25. Tab 24 is used to mount a side finger 33, to be described later. Tab 25 is used to mount a weight 26 using a machine screw 27 and a nut 28.

Figure 7:
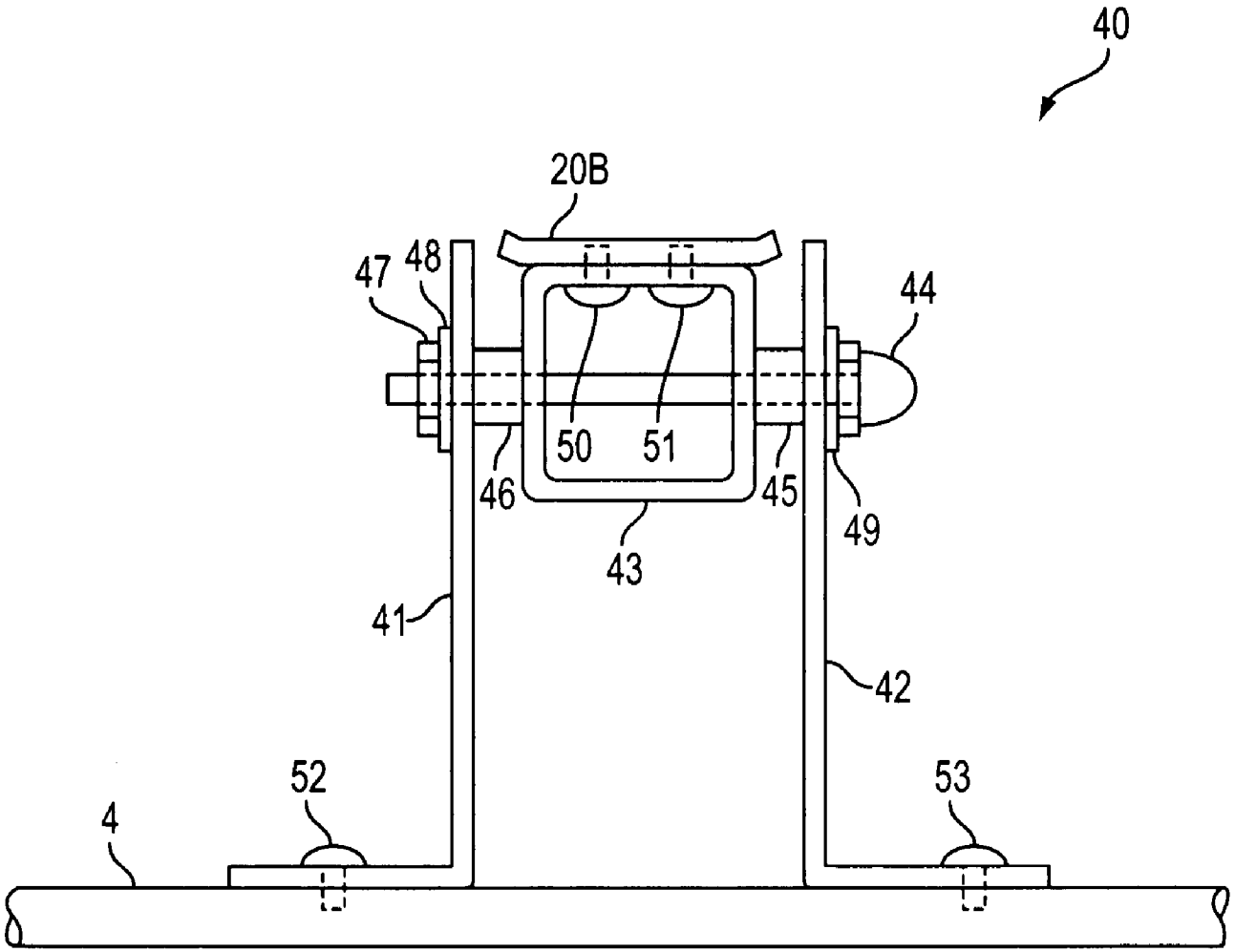
FIG. 7 is an isolated view of the assembly attaching the stationary arm to a base.

FIG. 7 shows the stationary channel 20B as connected with a support bracket and pivotal assembly 40, a view looking forward from just behind the assembly. Pivotal assembly 40 comprises two vertical brackets 41 and 42, joined by a bolt 44 which is inserted through two bushings 45 and 46 and an attachment fixture 43, bolt 44 being secured by a nut 47. This arrangement holds brackets 41 and 42 apart such that the stationary channel 20B can rotate upwardly and downwardly between them, bolt 44 forming an axle. Washers 48 and 49 improve the pivotal action of the assembly. Attachment fixture 43 is connected with the underside of the stationary channel 20B by two machine screws 50 and 51 screwed into tapped holes cooperatively located on stationary channel 20B. The assembly is located approximately at the mid-span of stationary channel 20B, and is further connected with a base 4 (see FIG. 1) by two machine screws 52 and 53 into cooperatively located tapped holes in base 4.

Figure 8:
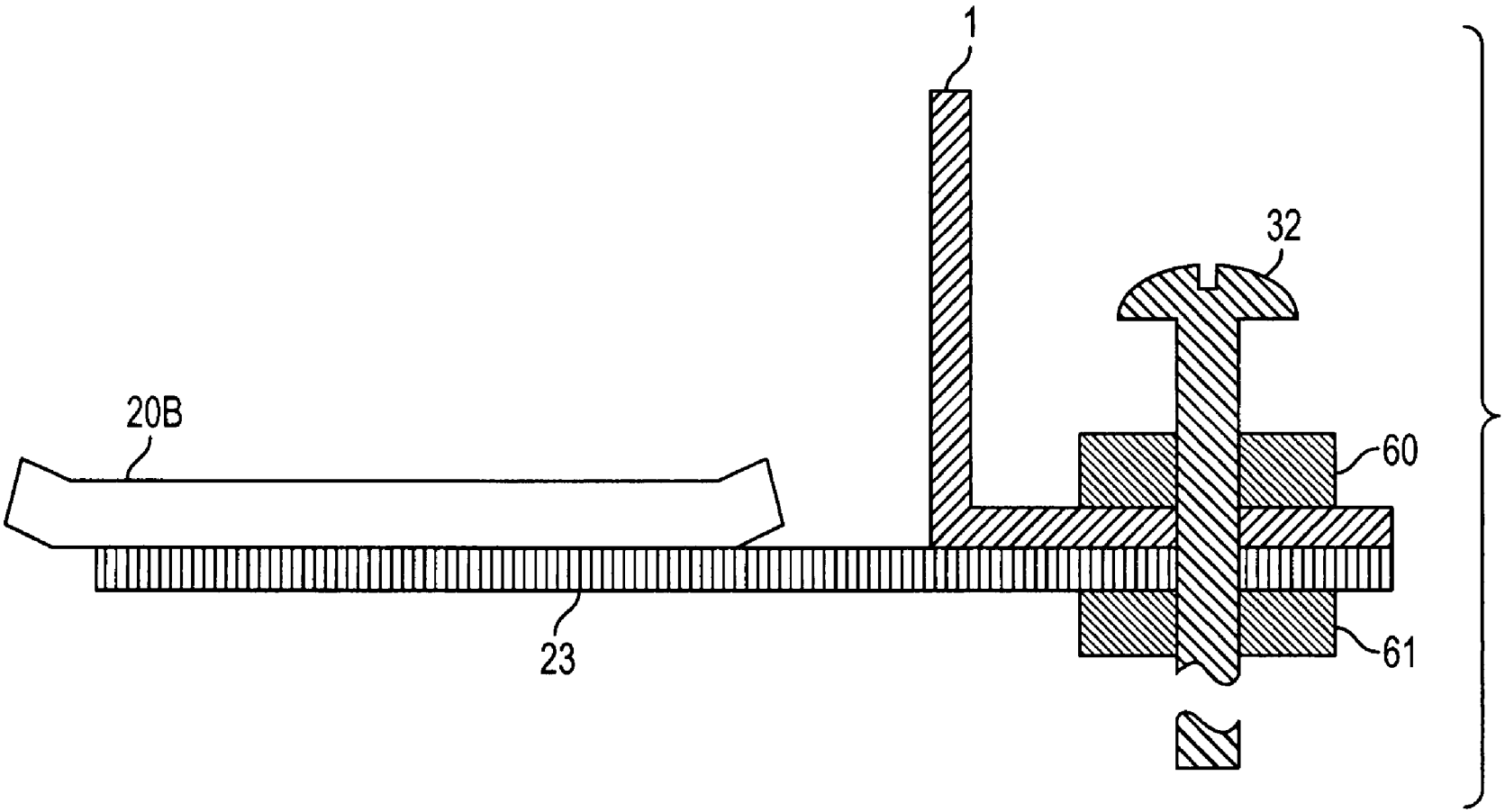
FIG. 8 is a cross section, detailing the attachment of the front or rear foot with the horizontal arm and the stationary arm.

Referring again to FIG. 2, note the dotted outline suggesting the position of stationary channel 20B relative to horizontal arm 1. Holes 34 and 35 in tabs 22 and 23 (FIG. 6), respectively, line up with holes 2 and 3 in horizontal arm 1. In FIG. 8, shown in cross section, there is a front foot 32 through holes 35 and 3, front foot 32 being a machine screw held in place by two jam nuts 60 and 61. Plate 23 and the horizontal portion of horizontal arm 1 are between jam nuts 60 and 61. Note a similar foot, rear foot 31. FIG. 8 is identical to the assembly at rear foot 31, thus horizontal arm 1 is fixedly connected with stationary channel 20B in two places.

Front foot 32 serves an alignment purpose. When extendable arm 20A is at its most extended position, shown in FIG. 1, ball support 30 is at its lowest position, horizontal arm 1 having been downwardly rotated, therefore extendable arm 20A as well. Front foot 32 length is such that ball support 30 is below the receiving (top) end of tee 31 but does not touch the surface of base 4. Similarly, rear foot 31 is of such a length that horizontal arm 1 is in an approximately horizontal position when extendable arm 20A is in its most retracted position and horizontal arm 1 is rotated upwardly.

Referring to FIG. 3, a belt loop 10 runs between front wheel 9 and drive wheel 6. In one embodiment the belt 10 is a toothed type belt and front wheel 9 and drive wheel 6 are also toothed with a matching pattern. Belt 10 is secured to extendable arm 20A by a clip 11. When belt 10 is moved by the rotation of drive wheel 6, the force is transmitted to clip 11 by belt 10, and clip 11 then transmits that force to extendable arm 20A, causing it to move in the direction dictated by the direction of drive wheel 6.

Figure 9:
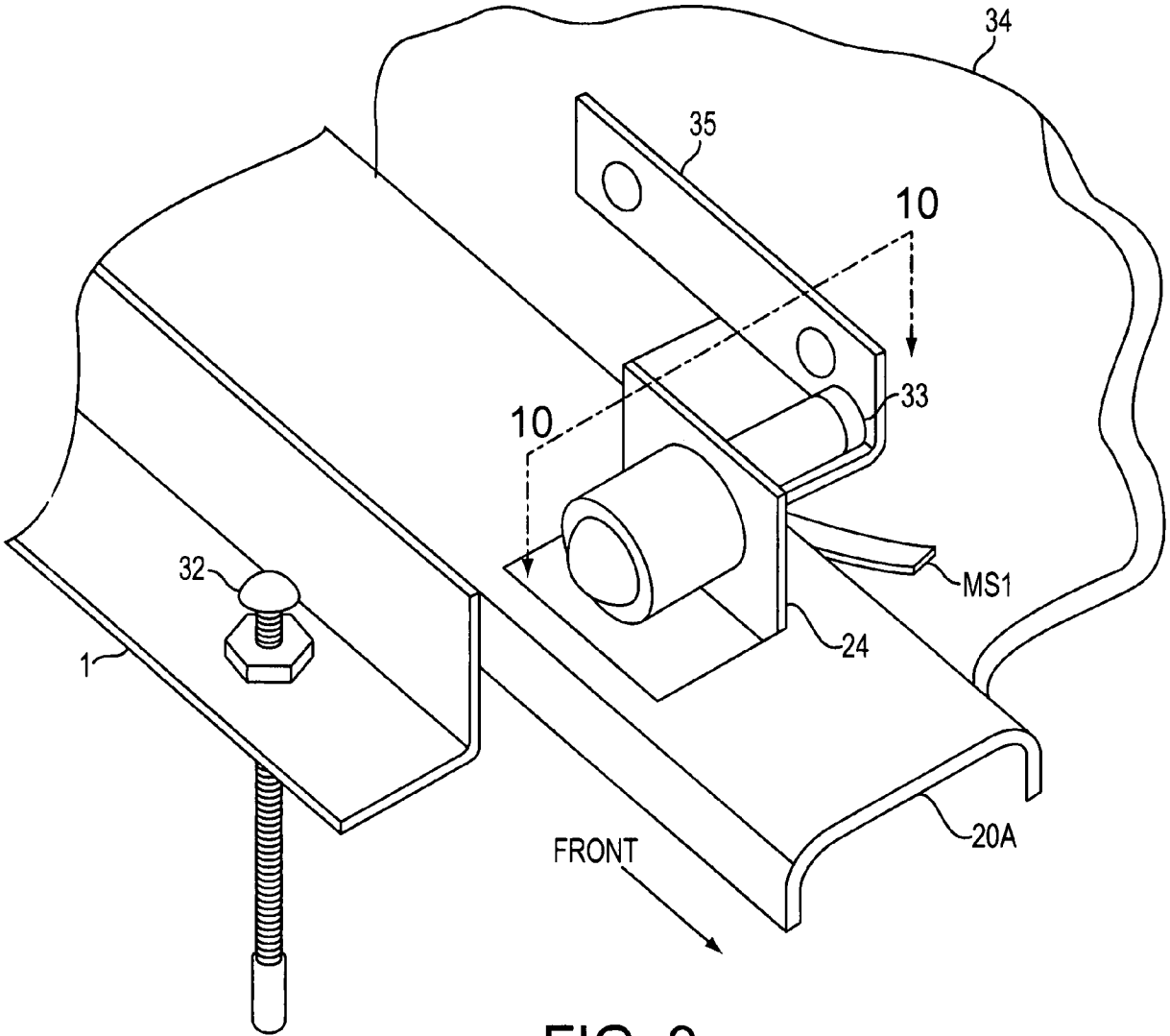
FIG. 9 is an isolated view of a finger riding upon a guide, approaching a limit switch.
Figure 10:
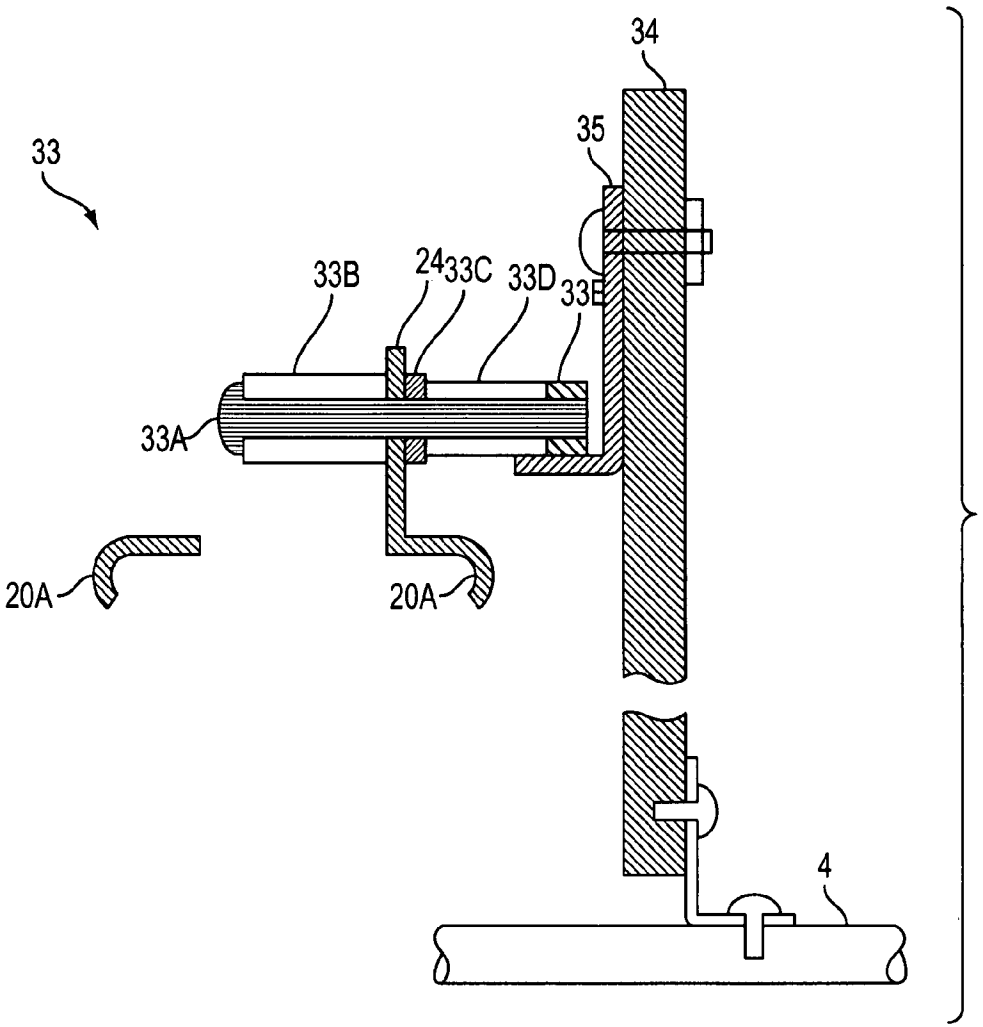
FIG. 10 is a cross section of the side finger and horizontal guide of FIG. 9.

As seen in FIG. 1 and FIG. 9, a vertical plate 34 is connected with the surface of base 4 and is positioned parallel to and close to extendable arm 20A. Connected with vertical plate 34 is a horizontal guide 35. Connected with tab 24 is a side finger 33. The cross section in FIG. 10 (looking rearward), details finger 33, comprised of a machine screw 33A though a barrel 33B, a hole in tab 24, a nut 33C, another barrel 33D, and a securing nut 33E which has been ground down to the diameter of barrel 33D. Barrels 33B and 33D may be of any sound material, such as nylon or metal. The end 33E is metal so as to withstand the wear that would be associated with the reciprocating motion of side finger 33 over horizontal guide 35. In another embodiment, end 33E has bearings or a wheel for less friction. The height of 33A and the height of horizontal guide 35 above base 4 are such that horizontal arm 1 will be held in an approximately horizontal attitude as extendable arm 20A moves forward and side finger end 33E rides upon horizontal guide 35.

Figure 6B:
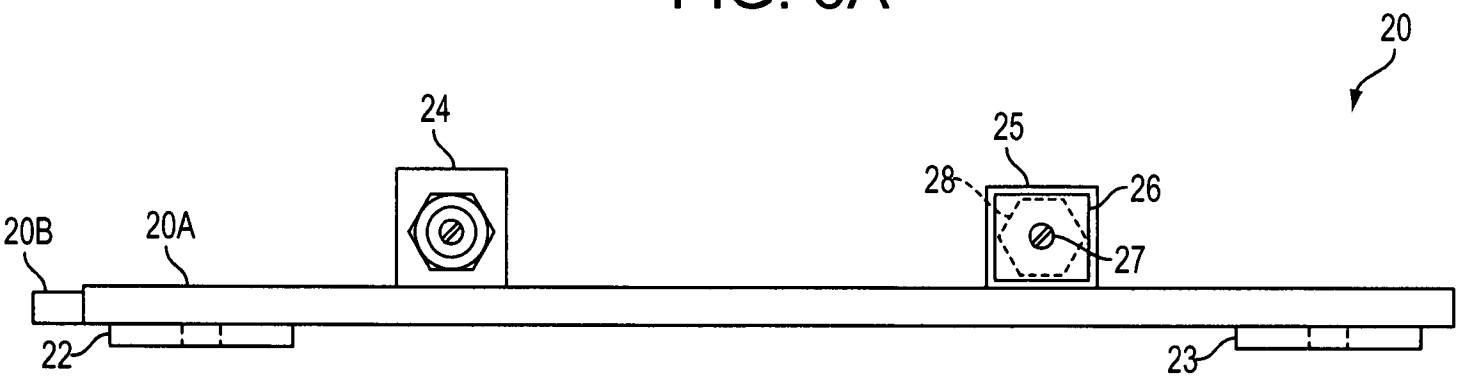
FIG. 6B is a side view of FIG. 6A.

FIG. 9 shows a perspective view of side finger 33 just before it clears the front edge of horizontal guide 35. When extendable arm 20A reaches its forward most extension the finger 33 clears horizontal guide 35. If the ball support 30 (fixedly connected with the front end of extendable arm 20A) is holding a golf ball, the weight of the combination will cause horizontal arm 1 to rotate downwardly such that the extendable arm 20A, thus ball support 30, will also rotate downwardly. When ball support 30 is below the elevation of the receiving end of tee 31, the ball will come to rest atop the tee 31. Continued downward movement of horizontal arm 1 (as well as extendable arm 20A) is stopped by front foot 32 when foot 32 hits the top surface of base 4. This is the position illustrated in FIG. 1. After the ball support 30 falls below the level of the receiving end of tee 31, finger 33 will actuate a front limit switch "FLS" 104 which sends a signal to the control circuit to reverse the direction of motor 5 and drive wheel 6 until extendable arm 20A returns to its fully retracted position. When extendable arm 20A is retracted approximately half way the center of gravity of the combination of horizontal arm 1 and extendable arm 20 (with all their described attached elements) will be behind axle 44, causing horizontal arm 1 to rotate upwardly until stopped in an approximately horizontal position by rear foot 31. Upon full retraction of extendable arm 20A, finger 33 actuates a rear limit switch "RLS" 106 which sends a signal to the control circuit to stop motor 5. For the case wherein no golf ball is present in ball support 30 when extendable arm 20A extends, a weight 26 approximating that of a golf ball is connected with tab 25, held by machine screw 27 and nut 28 (FIG. 6A and FIG. 6B).

FIG. 18 presents the above described steps. FIG. 18A is an overhead view where we see side finger 33 as extendable arm 20A is moving towards tee 31 and side apparatus 33 is being supported by horizontal guide 35. FIG. 18B shows the same position in a side view; side finger 33 is represented by dotted lines. FIG. 18C shows side finger 33 when extendable arm 20A is at is fully retracted position, wherein it makes contact with RLS 106. FIG. 18D shows side finger 33 after it has cleared horizontal guide 35 (that is, horizontal guide 35 no longer supports extendable arm 20A) and rotated downwardly, thus the most fully extended position. Side finger 33 makes contact with FLS 104 in this position.

Alternative embodiments will be apparent to those skilled in the art. In one embodiment front foot 32 and rear foot 31 are manufactured with fixed, appropriate lengths. In another embodiment horizontal arm 1 and stationary channel 20B are molded as a single unit. In another embodiment motor 5 is mounted near the middle of horizontal arm 1 and a rack and pinion used instead of belt 10 to move extendable arm 20A. In this case drive wheel 6 is a pinion gear, and the rack is mounted on the top surface of extendable arm 20A, their separation such that the pinion gear 6 engages the rack; front wheel 9 is not necessary in this embodiment. In another embodiment belt 10 is smooth, as are front wheel 9 and drive wheel 6, and belt 10 is tightly stretched between them to create adequate friction to drive extendable arm 20A. Others may be easily seen as obvious alternative embodiments of the invention. This description is intended to describe the invention in function, not implying a singular method of manufacture or implementation.

The above describes the mechanics of moving extendable arm 20A through a complete extension, lowering, retraction and re-leveling sequence, the result of which is the transport of a golf ball from the ball support 30 to the receiving end of tee 31. The following describes golf ball storage and movement for placing a golf ball upon ball support 30.

Figure 11:
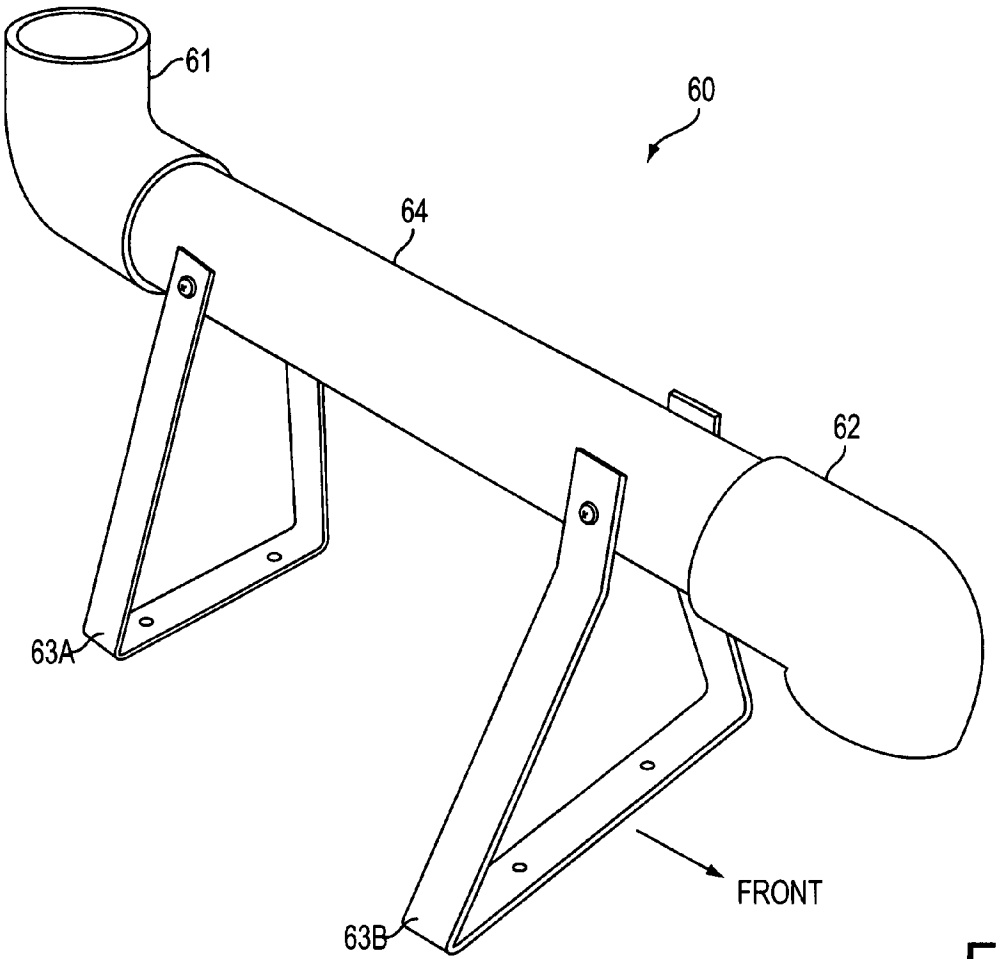
FIG. 11 is an isolated view of the delivery tube assembly and support brackets.
Figure 12:
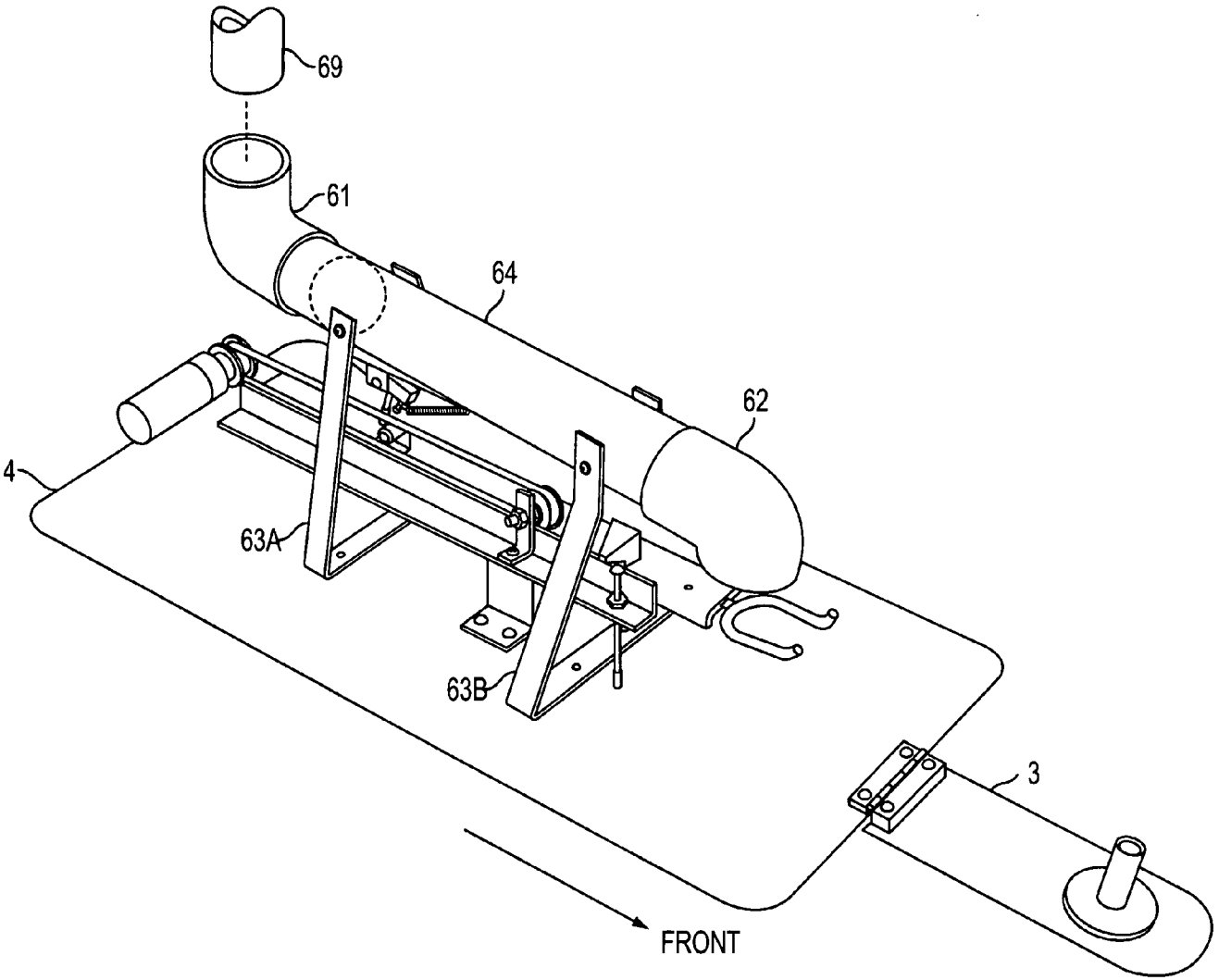
FIG. 12 shows the spatial relationship between the major components in the retracted position, including the discharge end of the tube over the fingers which support a golf ball.

The means for movement of a golf ball is gravity. Referring to FIG. 11, delivery assembly 60 is comprised of a transport tube 64, a receiving tube 61, a discharge tube 62, a rear support 63A and a front support 63B. As seen in FIG. 12, transport tube 64 is held above and aligned with horizontal arm 1 and extendable arm 20A by rear support 63A and front support 63B. Supports 63A and 63B hold transport tube 64 high enough to cause discharge tube 62 to be positioned directly over ball support 30 when extendable arm 20A is in its fully retracted position. Discharge tube 62 is far enough above ball support 30 that the golf ball will not strike discharge tube 62 as the ball support 30 is advanced by extendable arm 20A. However, discharge tube 62 should not be so high above ball support 30 as to cause the golf ball being discharged to bounce out of ball support 30. In one embodiment the down-going portion of discharge tube 62 has been shortened to reduce the overall height of tube assembly 60. Support 63A is taller (approximately 0.5 inch) than support 63B so that a ball will readily roll forward when released to do so. One or more golf balls are placed into receiving tube 61 by the user for future dispensing. Looking to FIG. 12, to increase the quantity of golf balls stored, an optional removable storage tube 69, similar to transport tube 64, is inserted into the receiving tube 61 at its intake (upper) point. The number of balls so stored is limited only by the length of optional tube 69. In another embodiment tube 69 is fitted with a container at its upper end to increase ball storage capacity. In another embodiment, tube 69 or receiving tube 61 is connected to a distribution means which supplies additional golf balls from a remote location.

In one embodiment, receiving tube 61 and discharge tube 62 are 1.75 inch PVC elbow connectors, commonly used for plumbing or irrigation sprinkler systems. Transport tube 64 is large enough inside to pass a golf ball, it's ends having been machined down to the proper diameter to fit into receiving tube 61 and discharge tube 62.

In another embodiment a one-piece tube singularly comprises tubes 61, 62, and 64. In another embodiment an outer case has the described golf ball passageway molded into the case itself. This would eliminate the need for supports 63A and 63B.

Figure 13:
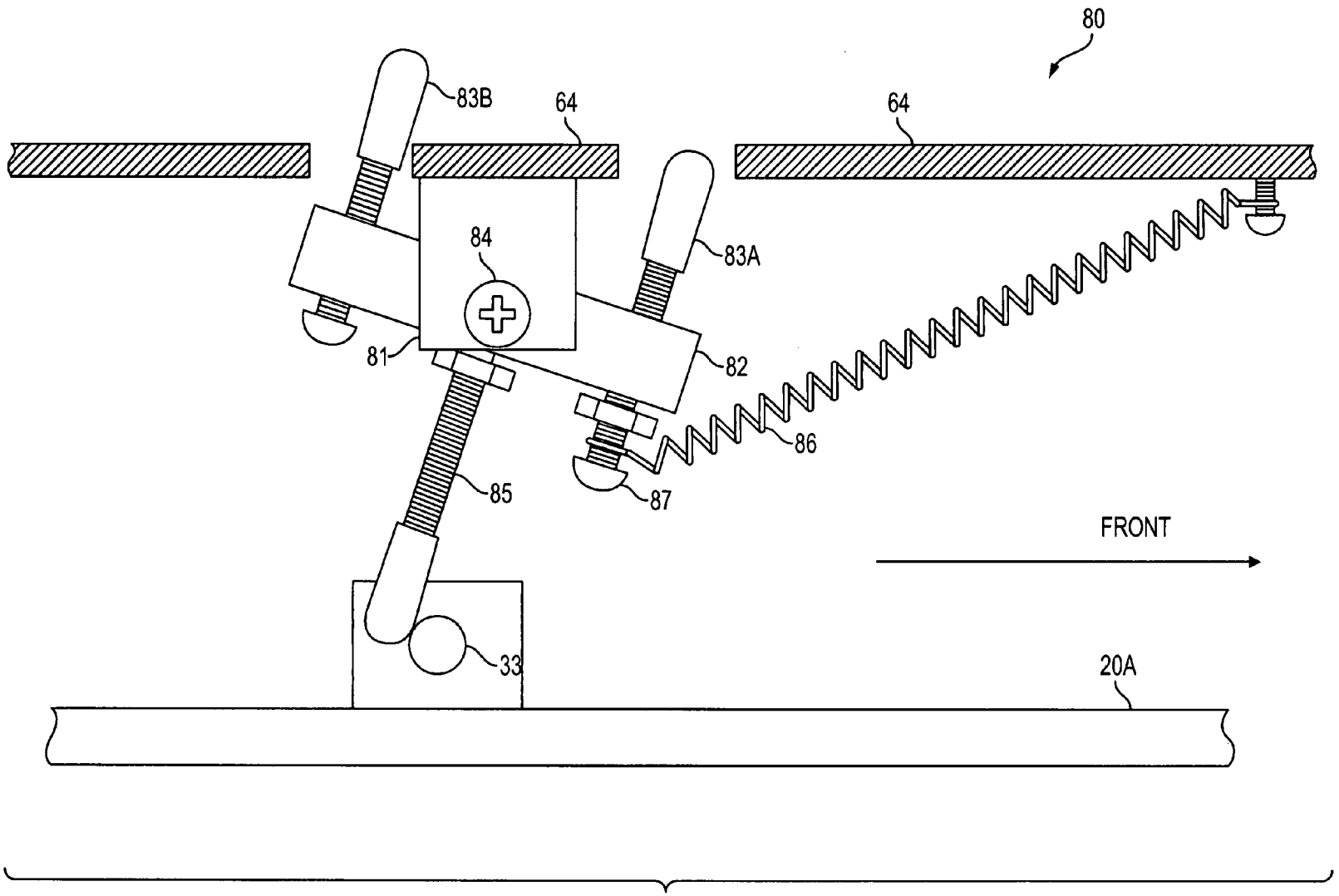
FIG. 13 is a detailed view of a gate mechanism assembly, with the extendable arm in the fully retracted position.

An element of the sequence of controlling golf ball movement is a means to release balls onto the ball support 30 one at a time and only when desired. This is accomplished by a gate mechanism assembly 80 as shown in FIG. 13. Gate mechanism 80 is comprised of a mounting bracket 81 which is connected with transport tube 64, a moveable body 82, a front finger 83A and a rear finger 83B, an axle 84, an actuator rod 85 connected with moveable body 82, and a return spring 86. One end of return spring 86 is connected with transport tube 64 at a position forward of gate mechanism 80. The other end of spring 86 is secured to an attachment point 87 on moveable body 82. Fingers 83A and 83B are connected with moveable body 82.

Figure 14A:
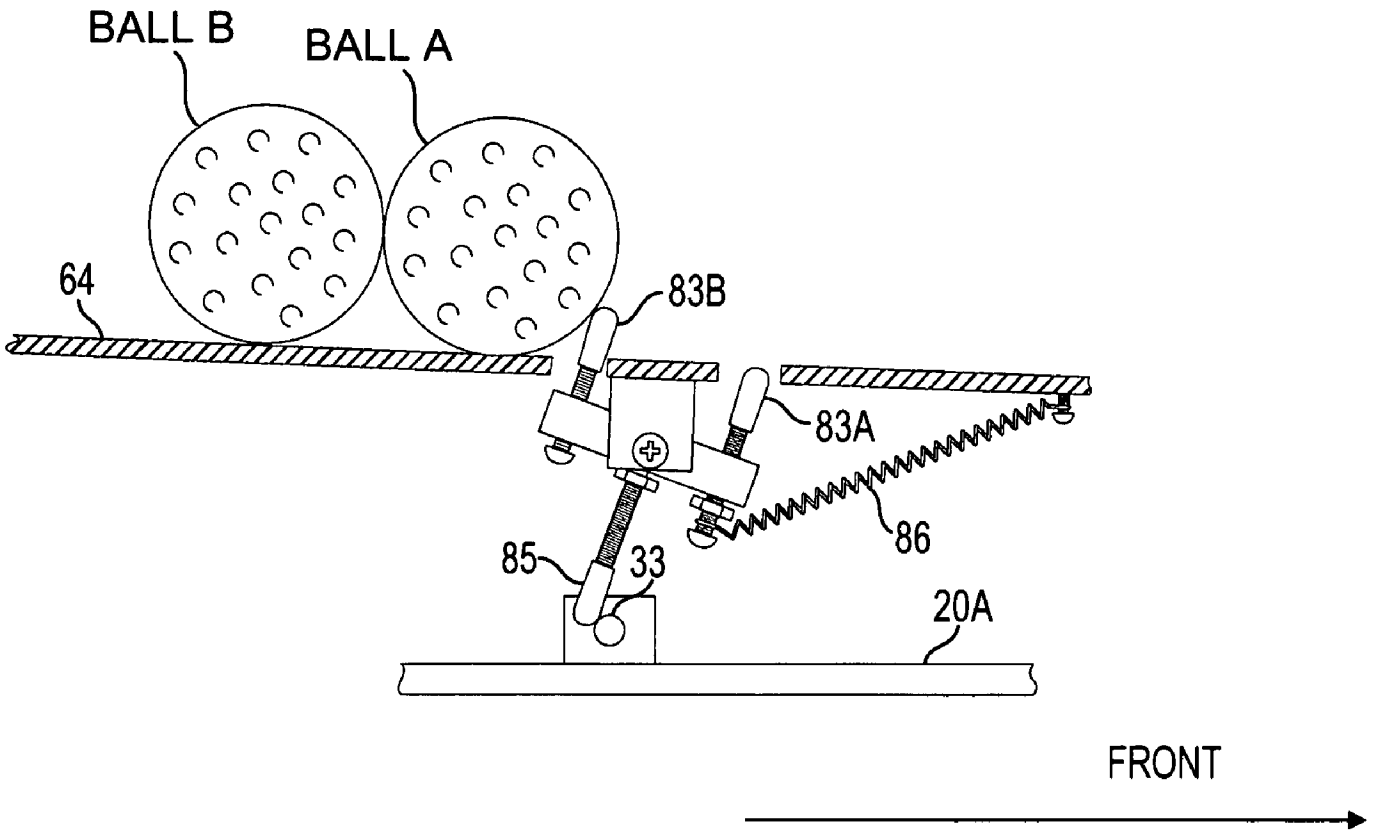
FIG. 14 is a detailed view of the gate mechanism assembly of FIG. 14, with the extendable arm in the extended position.
Figure 14B:
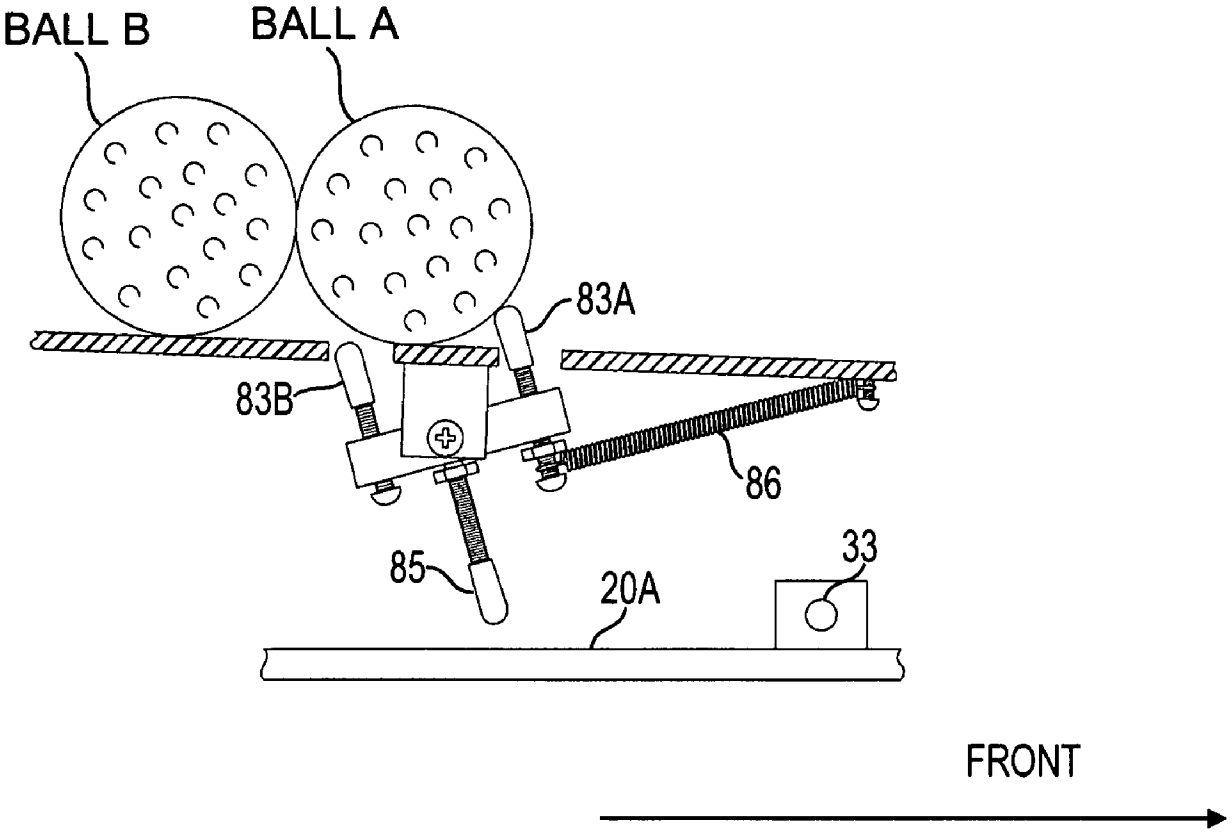
Figure 14C:
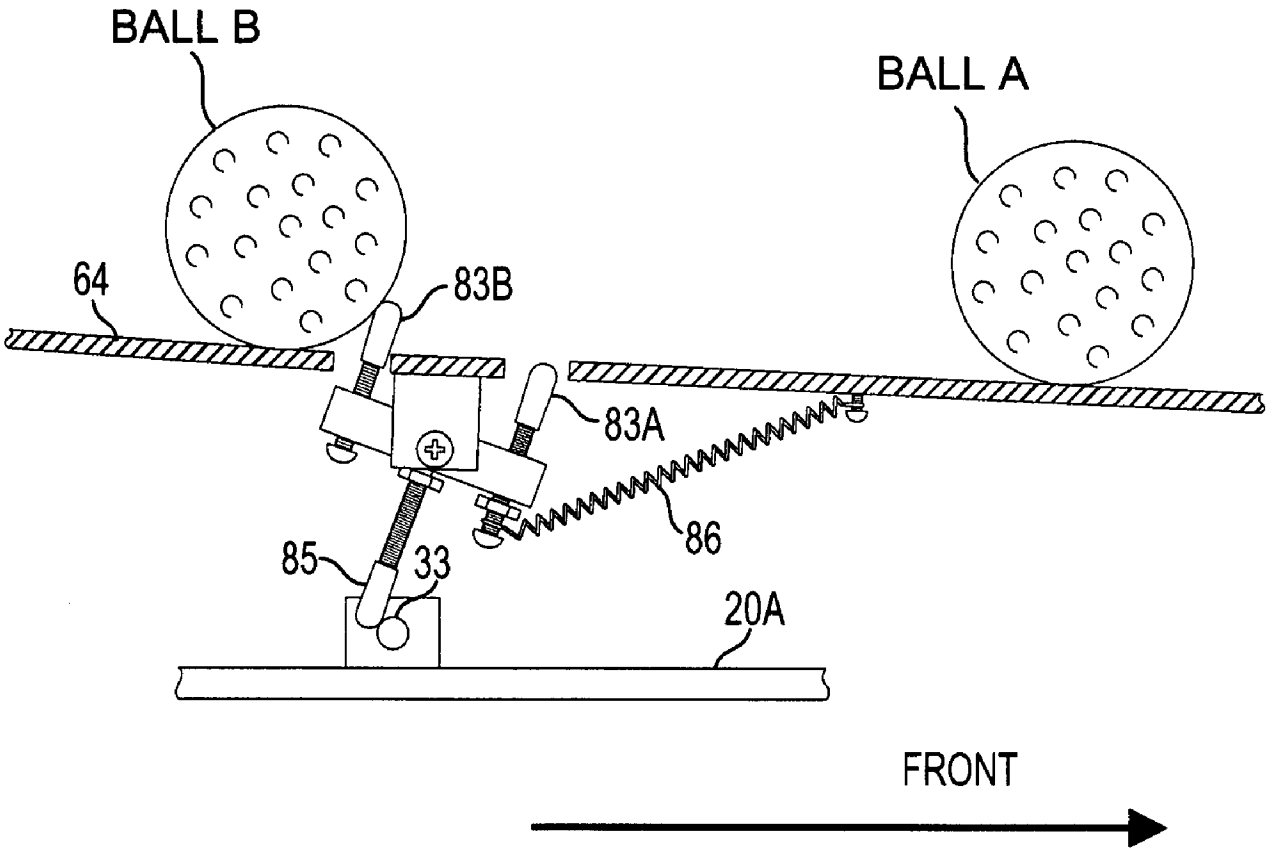

The operation of the gate mechanism is a three-step process, as illustrated in FIG. 14. In the first step, shown in FIG. 14A, extendable arm 20A is fully retracted. In this position side finger 33 holds actuator rod 85 rearward so that rear finger 83B holds back ball A, which in turn holds back ball B and any others that are in a queue. For purposes of illustration, assume there is a golf ball already upon ball support 30, waiting to be moved to tee 31. There are no other balls between ball support 30 and gate mechanism 80. In step 2, as shown in FIG. 14B, as a cycle for moving a ball from ball support 30 to tee 31 begins, extendable arm 20A is moved forward by belt 10. This moves finger 33 away from actuator rod 85. Spring 86 pulls on moveable body 82, rotating it about its axle 84, causing rear finger 83B to rotate downwardly, allowing all uphill balls to roll forward. As rear finger 83B goes down front finger 83A goes up, preventing ball A from advancing any further. Fingers 83A and 83B are separated by approximately the diameter of a golf ball (1.68"). The placement of axle 84 on mounting bracket 81 allows adequate clearance for moveable body 82 to rotate enough that fingers 83A and 83B stop a ball from rolling when raised and pass a ball when lowered relative to tube 64.

Extendable arm 20A continues its sequence for placing the ball upon tee 31. In step 3, illustrated by FIG. 14C, when extendable arm 20A completes its cycle by being fully retracted, finger 33 again pushes actuator rod 85 rearward. This releases ball A to roll forward. Ball A will progress through transport tube 64, exit discharge tube 62, coming to rest upon ball support 30. As finger 83A lowers to release ball A, finger 83B raises up to stop ball B from advancing any further. This completes the third step. Ball B is now in position to be the next released ball, and the system is ready for another cycle.

Figure 15:
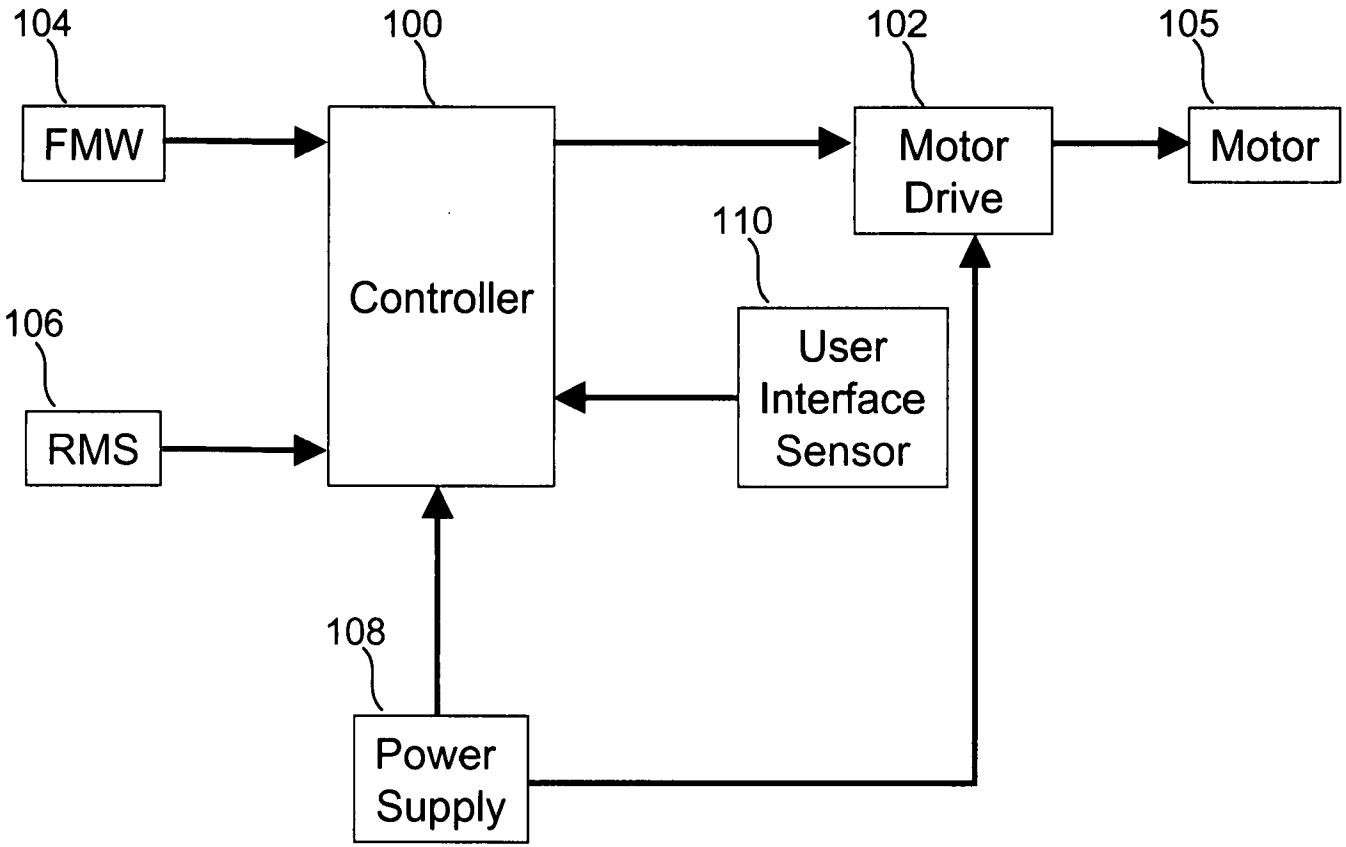
FIG. 15 is a sequence of positions for the gate mechanism for releasing exactly one golf ball.

The subsystems of the invention are powered and controlled by an electromechanical circuit shown in block diagram form in FIG. 15. Power supply 108 provides dc voltage to a controller 100 and to motor drive 102. Controller 100 detects the position of extendable arm 20A by determining the states of FLS 104 and RLS 106. When extendable arm 20A is fully retracted it activates FLS 106. When the user actuates user interface sensor "UIS" 110 it sends a signal to controller 100, which then signals motor drive 102 to connect power supply 108 to motor 105 with a voltage polarity that causes forward motion of extendable arm 20A. When extendable arm 20A is at its fully extended position it rotates downwardly bodily with horizontal arm assembly 17. Side finger 33 makes contact with FLS 104. When controller 100 detects the actuation of FLS 104 it sends a signal to motor drive 102 to reverse the polarity of the voltage connected with motor 105. Motor 105 reverses direction, causing extendable arm 20A to retract. When extendable arm 20A is fully retracted, side finger 33 will make contact with RLS 106, at which time controller 100 signals motor drive 102 to remover power from motor 105.

Figure 16A:
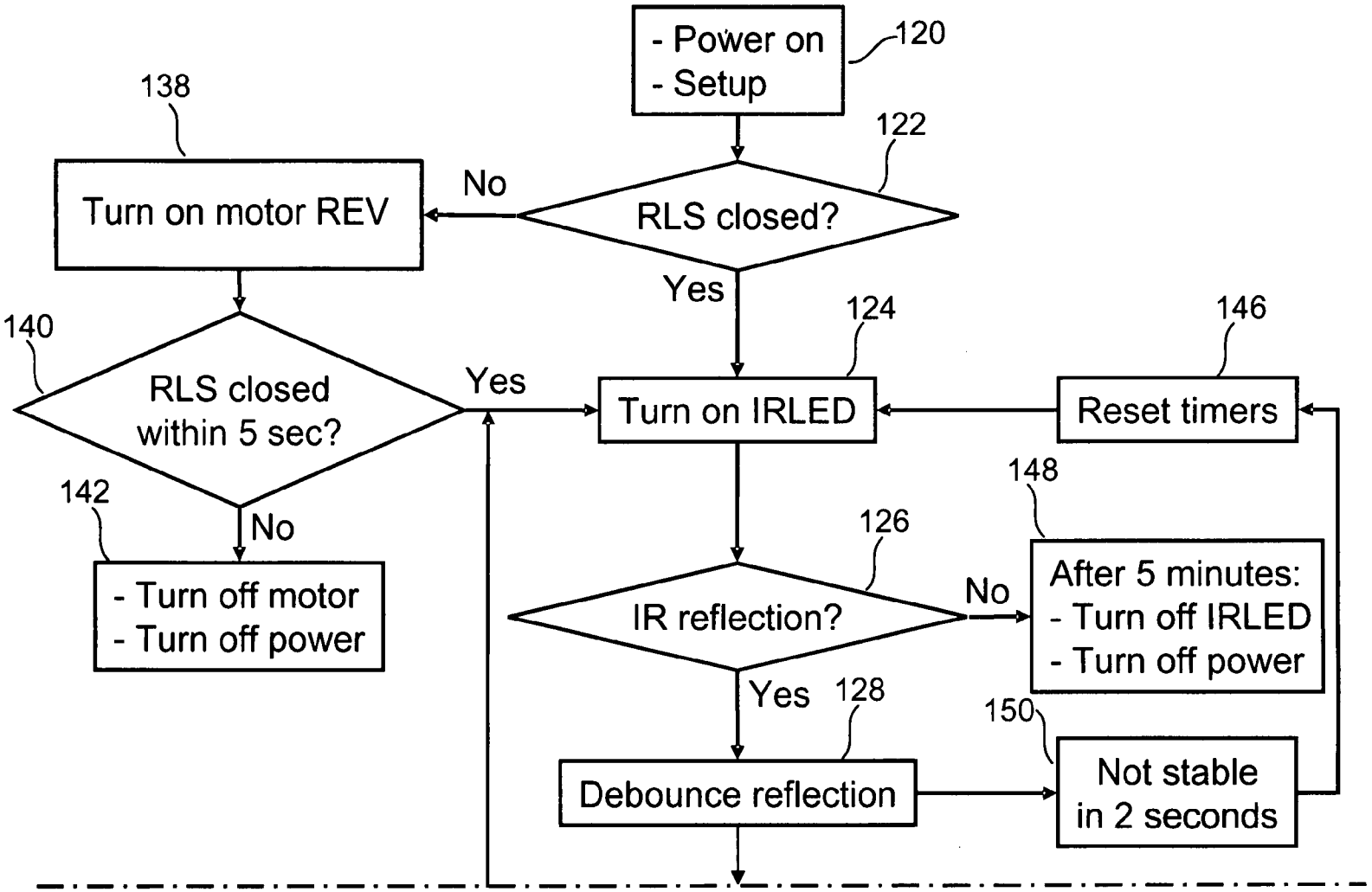
FIG. 16 is a block diagram of an electronic power and control system.
Figure 16B:
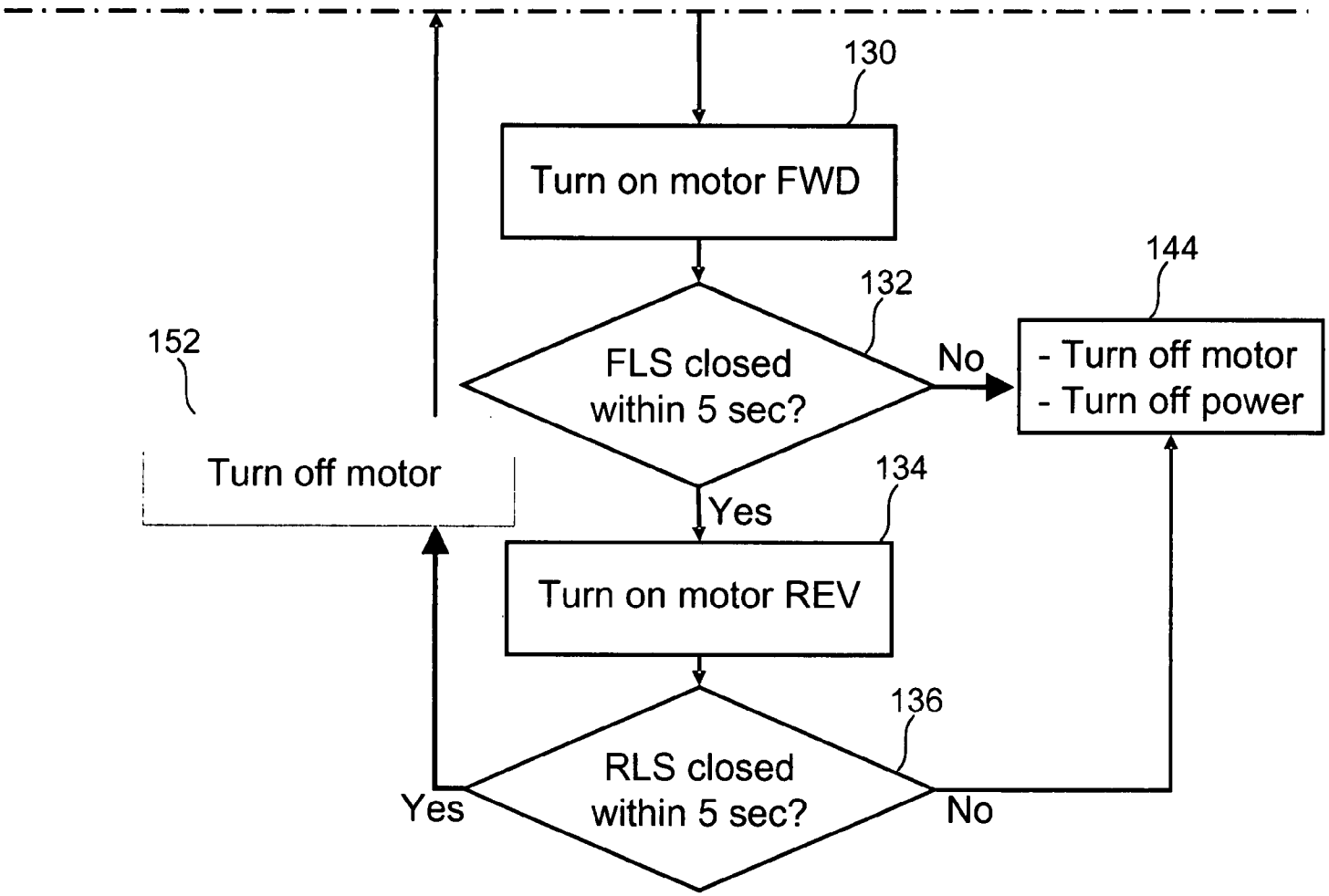

The program of controller 100 includes means for checking for proper operation, detecting such conditions as a stuck extendable arm 20A or a bad FLS 104 or RLS 106. A program flow is shown in FIG. 16.

When power is applied at step 102 the program first sets up the microcontroller 100 on-chip resources. At step 122 we check to see if switch RLS 106 is closed. If it is not, we know that extendable arm 20A is not fully retracted. In response we go to step 138, turn on the motor 105 in the "reverse" direction, then check at step 140 for closure of RLS 106. If RLS 106 does not close within 5 seconds the system assumes extendable arm 20A is stuck and goes to step 142 to turn off motor 105 and remove power from the rest of the system. Restarting (at step 120) requires that the user interrupt power. If RLS 106 was seen to be closed within 5 seconds at step 140, or if it were closed when entering step 122, the next step is 124. At step 124 we turn on an IR LED, then wait at step 126 to detect an IR reflection. If no reflection is seen for five minutes the system times out, goes to step 148, turns off the IR LED and removes power. As before, power must be interrupted to start over at step 120.

If an IR reflection is seen we check for a stable signal. If the reflection is not stable we go to step 150, reset the timers at step 146, and return to step 124 to again turn on the IR LED and wait for a reflection or the passing of 5 minutes. When a stable reflection is detected we advance to step 130, where we turn on motor 105 in the "forward" direction. Then at step 132 we check for FLS 104 to close within 5 seconds. If it does not we again assume a fault condition and go to step 144, where we turn off the motor 105 and turn off power to the system.

If FLS does close within five seconds then we know that the system is behaving properly, and that extendable arm 20A has gone to its maximum extended point, dropped (when side finger 33 cleared horizontal guide 34), and deposited the golf ball (if one were present) upon tee 31. In response we go to step 134 to turn on motor 105 in the reverse direction. If RLS 106 does not close within 5 seconds a fault condition is determined, and we go to step 144 to turn off motor 105 and remove power from the system.

If RLS 106 closed within 5 seconds, then the system is behaving properly, we know extendable arm 20A is at its most retracted position (and that a golf ball has been released by gate 80 if there were a ball waiting to be released), so at step 152 we turn off motor 105 and return to step 124 to turn on IR LED and begin the process anew.

An example of a program which implements the flow of FIG. 16 is listed in APPENDIX 1. Controller 100 in one embodiment is a microcontroller. This may be a very low end controller, even a four bit device, in that the function of controller 100 is simply to sense, sequence, connect or disconnect, and count (time). In another embodiment controller 100 is designed using discrete logic, with the flow of FIG. 16 describing its behavior.

Figure 17:
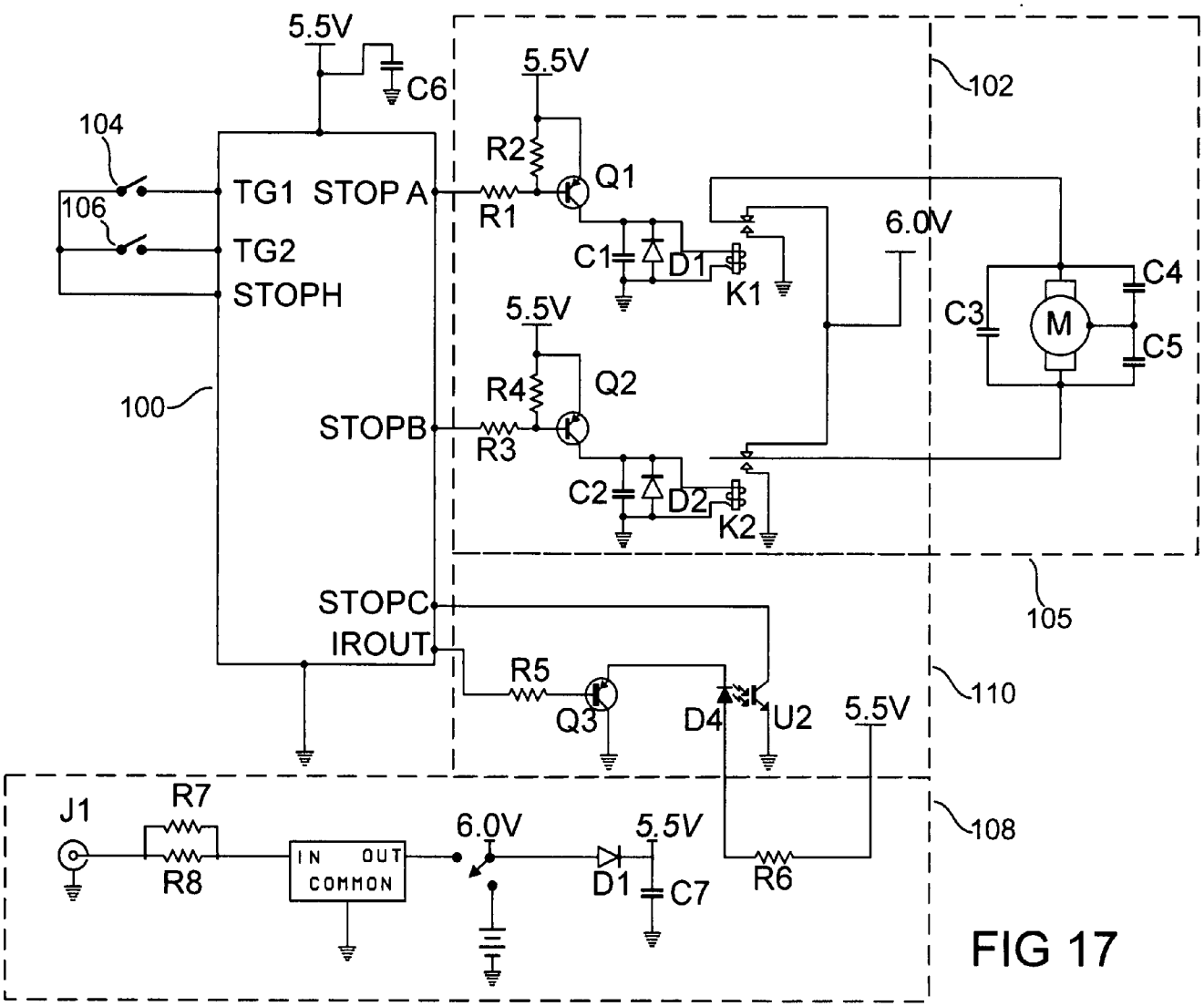
FIG. 17 is a schematic of an electronic power and control system.
Figure 18A:
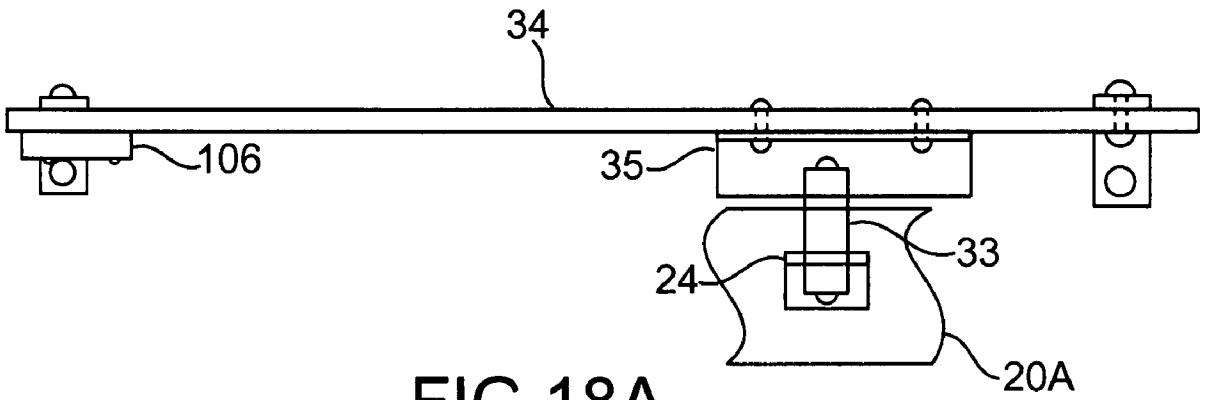
FIG. 18 shows the relationship between a side finger and the horizontal guide and the forward and reverse limit switches.
Figure 18B:
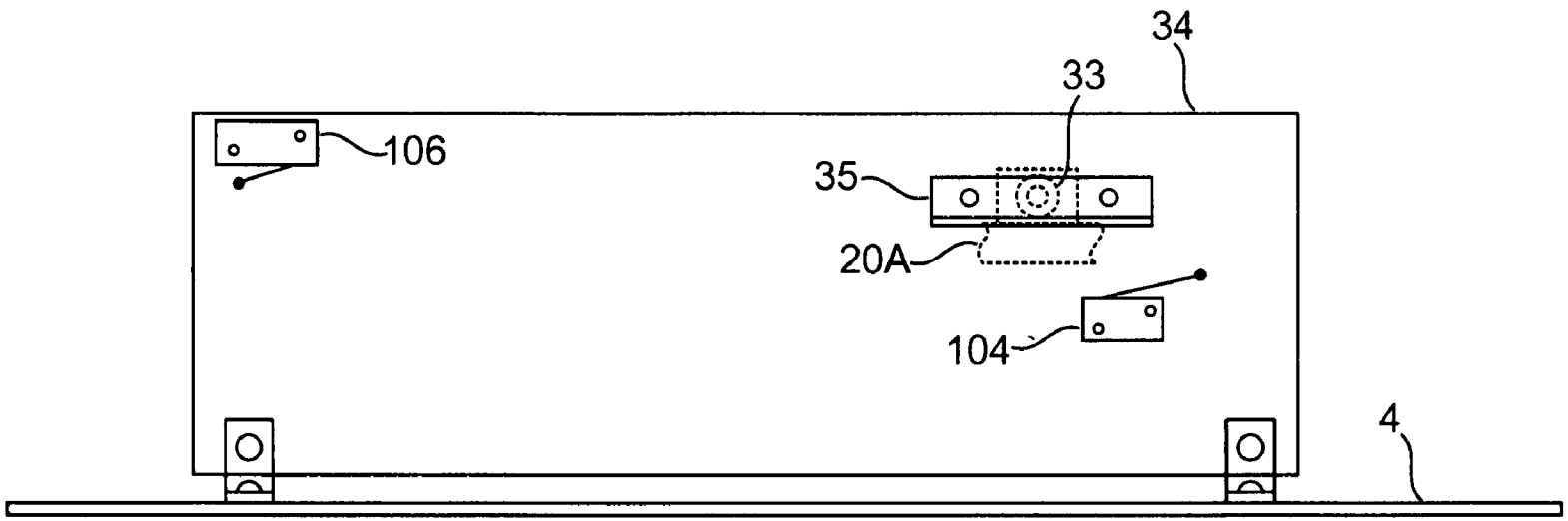
Figure 18C:
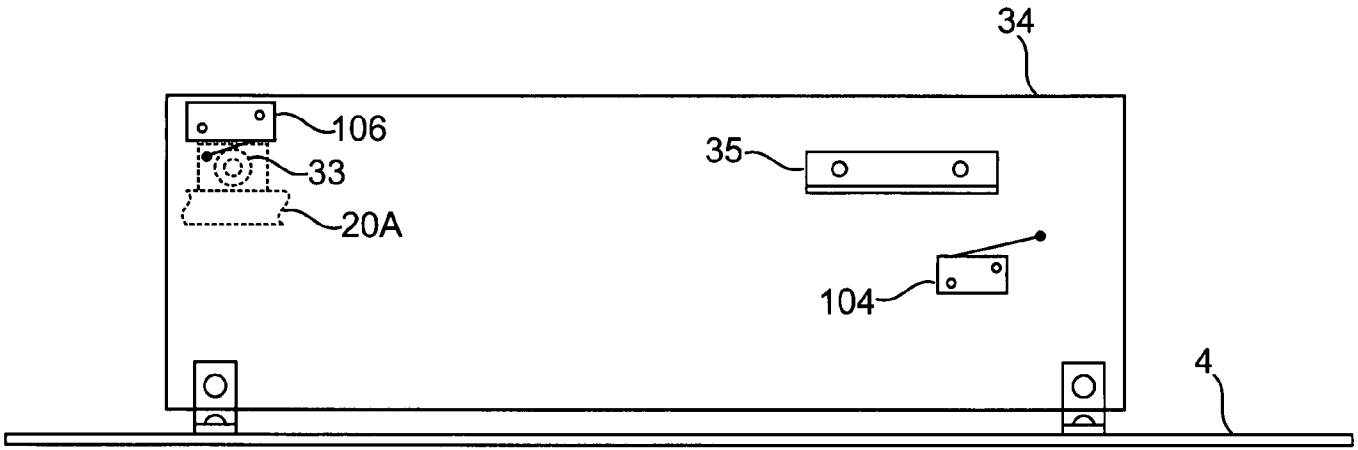
Figure 18D:
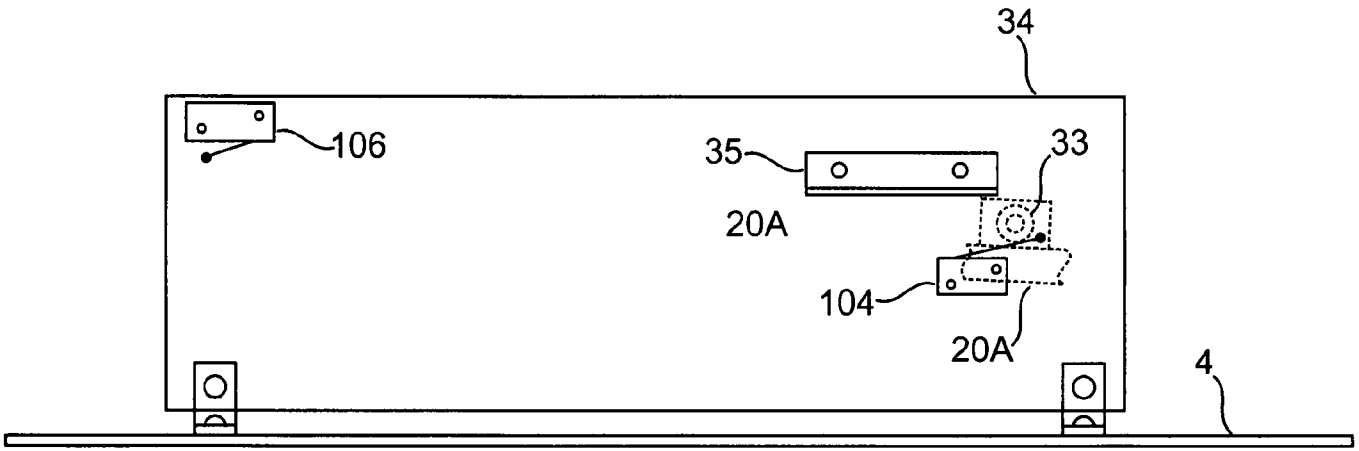

One skilled in the art will recognize many alternative embodiments for the blocks from the diagram of FIG. 15. Looking to FIG. 17 we see an example circuit implementation of the block diagram of FIG. 15. FLS 104 and RLS 106 are connected to input pins of controller 100, with a common return STOPH 200. The circuit block implementations corresponding to motor drive 102, motor 105, user interface sensor 110, and power supply 108 are indicated on FIG. 17. One skilled in the art will recognize alternative embodiments for any one or all of these blocks.

APPENDIX 1

```
; tg1 arm forward sw, active low
; tg2 arm back sw, active low
; both tg1 and tg2 are switched to stop h
; tg6 is IR sensor in. (club sense)
; stop C controls IR out
; stop A is low motor forward
; stop B is low motor reverse
;*****************************************************
freq2
32:
    ;power up/reset
    ld mode0, 11011111b
    ld mode1, 11111111b
    ld en0, 00000000b          ; disable all triggers
    ld en1, 00001000b          ;keep trigger 8 on to prevent reset
    ld stop, 11111011b         ;turn off IR
    one
    [500 msec]
    h5+armback+t5
    ld stop, 01111011b         ;enable low common to limit switches
    jp 1 @TG2_low              ;pull back arm if not already
    ld en0, 00000010b
    ld stop, 01111001b         ;pull arm back
    [1000msec]                 ;5 seconds to pull back arm
    [1000msec]
    [1000msec]
    [1000msec]
    [1000msec]
    ld stop, 11111011b         ;stop motors
    h5+armstuck+t5
    end
;-----------------------------------------------
;here on falling edge of arm out switch
;-----------------------------------------------
0:
    ld en0, 00000100b
```

APPENDIX 1-continued

```
    ld stop, 11111011b          ;stop motor
    h5+armback+t5
    ld stop, 01111011b          ;enable low common to limit switches
    jp 1 @TG2_low               ;pull back arm if not already
    ld en0, 00000010b           ; enable back location switch
    ld stop, 01111001b          ;pull arm back
    [1000msec]                  ;5 seconds to pull back arm
    [1000msec]
    [1000msec]
    [1000msec]
    [1000msec]
    ld stop, 11111011b          ;stop motors
    h5+armstuck+t5
    end
1:
    ;here when arm is all back
    jp 50
50:15
    ;wait for ir trigger
    ld en0, 00000100b           ;disable triggers
    ld stop, 11111111b          ;turn on IR beam
    jp 70 @tg6_low              ;look for ir beam reflection
    [250msec]
    jp 70 @tg6_low
    [250msec]
    jp 70 @tg6_low
    [250msec]
    jp 70 @tg6 low
    [250msec]
    jp 70 @tg6_low
    [250msec]
    jp 70 @tg6_low
    [250msec]
    jp 70 @tg6_
```

APPENDIX 1-continued

```
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
jp 70 @tg6_low
[250msec]
ld stop, 11111011b          ;turn off IR
[100 msec]
ld en0, 00001111b           ;reset problem
[100 msec]
end                 ;go to sleep
jp 50@tg6_high          ;see if reflection goes away
[50 msec]
jp 50 @tg6_high
[50 msec]
jp 50@tg6_high
[50 msec]
jp 50 @tg6_high
[50 msec]
jp 50 @tg6_high
;club still reflecting, put out ball
ld stop, 01111010B          ;turn on switch common, start motor
[100 msec]                  ;let power settle
ld en0, 00000001b           ;enable out switch
[1000 msec]
[1000 msec]
[1000 msec]
[1000 msec]
[1000 msec]             ;5 seconds to run motor, time out
ld stop, 11111011b          ;everything off
h5+armstuck+t5
end
```

I claim:

1. A golf ball teeing apparatus for dispensing golf balls comprising:

a base, including a base surface;

a tee platform, including a tee platform surface, tee platform connected with said base at an adjacent end and said tee platform surface being parallel to and approximately on the same plane as said base surface, the location of said tee platform connection with said base defining the front end of the apparatus;

a golf ball tee having an upper end disposed to support a golf ball and a bottom end connected with the tee platform surface, said tee positioned at an end of said tee platform in opposition to said base connection;

a means for placing a golf ball upon said tee, comprising a carrier slideably movable longitudinally, a golf ball support member connected with an adjacent end of the carrier, a guide finger extending laterally from the carrier perpendicular to the path of travel of the carrier, the carrier having a first position defined as the most rearward position of the carrier when the carrier is retracted wherein a golf ball is directed to said supporting member and a second position defined as the most forward position of the carrier when the carrier is extended, whereupon a golf ball is placed upon the tee and removed from the supporting member, the carrier then returning to the first position;

a gravity fed ball delivery tube having an upper end connected with a container for holding one or more golf balls and a lower end cooperatively located above said golf ball supporting member of said means for placing a golf ball upon the tee;

a ball gate assembly positioned along the ball delivery tube and operable upon the carrier being in the first position to release exactly one golf ball for travel through the ball delivery tube towards said golf ball supporting member;

a horizontal arm mounted intermediate its ends above the base for pivotal movement by gravity about a horizontal axis, the axis connected at each axis end with an axis support member fixedly connected with the base surface wherein the axis is displaced vertically from the base at a distance approximately corresponding to the height of the tee, wherein the means for placing a golf ball upon the tee is connected with and rotatable upwardly and downwardly bodily with the horizontal arm;

a forward limit foot fixedly connected with the horizontal arm extending from the horizontal arm towards the surface of the base wherein the length of the forward limit foot allows the means for placing a golf ball to rotate downwardly sufficient to place a golf ball upon the tee when the carrier is in said second position and prevents the ball carrier from striking the surface of the base;

a rear limit foot fixedly connected with the horizontal arm, the rear limit foot extending from the horizontal arm towards the surface of the base wherein the length of the rear limit foot prevents the horizontal arm from rotating upwardly beyond an approximately horizontal position when the carrier is in the first position;

a motor means including an output shaft, said motor means connected in an electric circuit with a power supply and cooperatively connected with the means for placing a golf ball upon the tee;

a control system means operatively associated with the motor means for automatically extending the carrier from the first position to the second position, then returning the carrier to the first position;

a vertical plate proximally located near and parallel to the longitudinal path of the carrier, said vertical plate including a horizontal guide wherein the guide finger on the carrier rides upon the horizontal guide when the carrier moves from the first position to the second position until the ball support means is positioned over the tee, whereupon the guide finger will clear the horizontal guide whereupon the horizontal arm will rotate downwardly until the forward limit foot comes into contact with the base;

means for a user to activate the control system to automatically place a golf ball upon the tee.

2. The apparatus of claim 1 wherein said connection with said tee platform and said base further comprises a hinge, wherein said tee platform is rotatable to an approximately vertical and to an approximately horizontal position.

3. The apparatus of claim 1 wherein said tee is of a resiliently flexible material.

4. The apparatus of claim 1 wherein said container for holding one or more golf balls is detachable.

5. The apparatus of claim 1 or claim 4 wherein said container for holding one or more golf balls further comprises a delivery means from a remote location to said delivery tube.

6. The apparatus of claim 1 further comprises an enclosure.

7. The apparatus of claim 1 wherein said motor means further comprises a forward roller rotatably connected with a mounting bracket, said mounting bracket fixedly connected with the horizontal arm, displaced from said motor by at least the distance of travel by the carrier from said first position to said second position; a drive wheel fixedly connected with said motor output shaft, said shaft forming an axle for said drive wheel; a belt encompassing said forward wheel and said drive wheel, said belt fixedly connected with said carrier.

8. The apparatus of claim 1 wherein said control system means further comprises a microcontroller.

9. The apparatus of claim 1 or of claim 8 wherein said control system means further comprises a battery for power supply.

10. The apparatus of claim 1 wherein said means for a user to activate the control system comprises a light emitting diode and a photo detector.

* * * * *